US011760106B2

(12) United States Patent
Yamaguchi

(10) Patent No.: US 11,760,106 B2
(45) Date of Patent: Sep. 19, 2023

(54) LIQUID EJECTING HEAD AND LIQUID EJECTING APPARATUS

(71) Applicant: SEIKO EPSON CORPORATION, Tokyo (JP)

(72) Inventor: Kei Yamaguchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 135 days.

(21) Appl. No.: 17/452,250

(22) Filed: Oct. 26, 2021

(65) Prior Publication Data

US 2022/0134769 A1 May 5, 2022

(30) Foreign Application Priority Data

Oct. 29, 2020 (JP) ..... 2020-181596

(51) Int. Cl.
*B41J 2/19* (2006.01)
*B41J 2/175* (2006.01)

(52) U.S. Cl.
CPC ..... *B41J 2/19* (2013.01); *B41J 2/17563* (2013.01)

(58) Field of Classification Search
CPC ..... B41J 2/19; B41J 2/17563; B41J 2202/19; B41J 2/14201; B41J 2002/14362; B41J 2002/14419; B41J 2202/20; B41J 2/18
See application file for complete search history.

(56) References Cited

U.S. PATENT DOCUMENTS

| | | | |
|---|---|---|---|
| 2008/0136860 | A1 | 6/2008 | Kyoso |
| 2015/0085032 | A1 | 3/2015 | Ando et al. |
| 2015/0258786 | A1 | 9/2015 | Akahane et al. |

FOREIGN PATENT DOCUMENTS

| | | | |
|---|---|---|---|
| JP | H06-143602 | A | 5/1994 |
| JP | 2008-142910 | A | 6/2008 |
| JP | 2015-058658 | A | 3/2015 |
| JP | 2015-174392 | A | 10/2015 |
| JP | 2015-214130 | A | 12/2015 |

OTHER PUBLICATIONS

Machine Translation of JP 2016159514, "Liquid Discharge Device and Foreign Matter Discharge Method For Liquid Discharge Head", Sep. 5, 2016 [First Embodiment and Second Embodiment]. (Year: 2016).*

* cited by examiner

*Primary Examiner* — Lisa Solomon
(74) *Attorney, Agent, or Firm* — WORKMAN NYDEGGER

(57) ABSTRACT

A liquid ejecting head configured to eject a liquid in a first direction includes: head units arranged side by side in a second direction orthogonal to the first direction and a flow channel member having a first supply flow channel through which the liquid is supplied to the head units, a first collection flow channel through which the liquid is collected from the head units, a first inlet portion through which the liquid is let into the first supply flow channel from the outside, and a first outlet portion through which the liquid is let out to the outside from the first collection flow channel. The first inlet portion and the first outlet portion are disposed near the center of the flow channel member in the second direction.

9 Claims, 22 Drawing Sheets

LIQUID EJECTING HEAD AND LIQUID EJECTING APPARATUS

The present application is based on, and claims priority from JP Application Serial Number 2020-181596, filed Oct. 29, 2020, the disclosure of which is hereby incorporated by reference herein in its entirety.

BACKGROUND

1. Technical Field

The present disclosure relates to a liquid ejecting head that ejects a liquid and a liquid ejecting apparatus, and particular to an ink jet recording head that ejects ink as the liquid and an ink jet recording apparatus.

2. Related Art

A liquid ejecting head includes a plurality of head units and a flow channel member that distributes and supplies a liquid to the plurality of head units.

The flow channel member has an elongated shape along a direction that the plurality of head units are arranged and includes a supply flow channel through which a liquid is distributed and supplied to each of the head units and a collection flow channel through which the liquid is collected from each of the head units. The liquid is supplied to the supply flow channel through an inlet portion and is distributed and supplied to the head units. Meanwhile, the liquid collected from the head units to the collection flow channel is let out to the outside through an outlet portion (see, for example, JP-A-2015-58658).

However, if the inlet portion and the outlet portion are disposed near a longitudinal end portion of the flow channel member, there arises a problem in that the flow channels leading to the respective head units in the flow channel member have different flow channel resistances from one another.

Note that this problem is seen not only in ink jet recording heads, but also in liquid ejecting heads that eject a liquid other than ink.

In view of such circumstances, the present disclosure has an object to provide a liquid ejecting head and a liquid ejecting apparatus capable of reducing variations in the flow channel resistance among the flow channels leading to the respective head units.

SUMMARY

To solve the above problem, an aspect of the present disclosure is a liquid ejecting head that ejects a liquid in a first direction and includes: a plurality of head units arranged side by side in a second direction orthogonal to the first direction and a flow channel member having a first supply flow channel through which the liquid is supplied to the plurality of head units, a first collection flow channel through which the liquid is collected from the plurality of head units, a first inlet portion through which the liquid is let into the first supply flow channel from outside, and a first outlet portion through which the liquid is let out to outside from the first collection flow channel. The first inlet portion and the first outlet portion are disposed near a center of the flow channel member in the second direction.

Another aspect of the present disclosure is a liquid ejecting apparatus that includes the liquid ejecting head according to the above aspect and a retention member that retains the liquid ejecting head.

DESCRIPTION OF EXEMPLARY EMBODIMENTS

Figure 1:
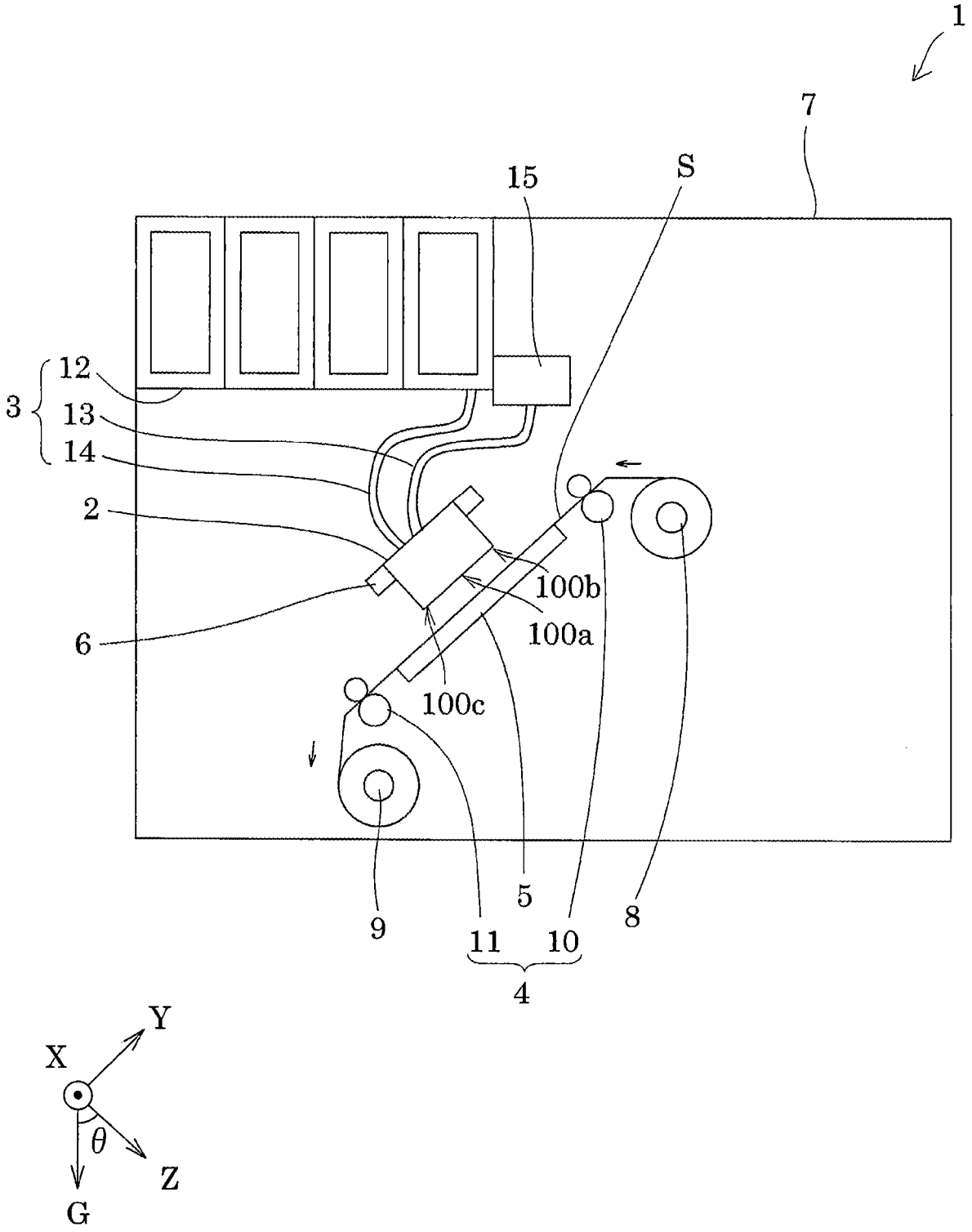
FIG. 1 is a diagram showing the schematic configuration of an ink jet recording apparatus.

The present disclosure is described in detail below based on an embodiment. It should be noted, however, that the following description demonstrates an aspect of the present disclosure, and any changes can be made within the scope of the present disclosure. Throughout the drawings, the same reference numerals denote the same members to omit descriptions where appropriate. In the drawings, X, Y, and Z represent the three spatial axes that are orthogonal to one other. Herein, directions along these axes are referred to as an X-direction, a Y-direction, and a Z-direction. In the following description, a direction pointed by an arrow in each drawing is a positive (+) direction, while a direction opposite from the direction of the arrow is a negative (−) direction. Also, "G" in each drawing denotes a spatial axis along the vertical direction, and a +G-direction, which is the direction pointed by an arrow, is vertically downward (also called the direction of gravitational force), while a −G-direction, which is the opposite from the direction pointed by the arrow, is vertically upward.

FIG. 1 is a diagram showing the schematic configuration of an ink jet recording apparatus 1, which is a liquid ejecting apparatus, according to one embodiment of the present disclosure. Hereinbelow, out of the three spatial axes X, Y, and Z, a +Z-direction denotes the direction in which ink droplets are ejected from an ink jet recording head 2 to be described later.

As shown in FIG. 1, the ink jet recording apparatus 1, which is an example of a liquid ejecting apparatus, is a printing apparatus that prints an image or the like by ejecting ink, which is a type of liquid, as droplets so that they land on a medium S, such as a printing sheet, and thereby forming arrays of dots on the medium S. Other than a recording sheet, the medium S may be any material such as a resin film or a cloth.

The ink jet recording apparatus 1 includes the ink jet recording head 2 (hereinafter also referred to simply as a recording head 2), which is an example of a liquid ejecting head, a liquid supply section 3, a transport mechanism 4 that transports a medium S, a support platform 5, and a retention member 6. The recording head 2, the liquid supply section 3, the transport mechanism 4, the support platform 5, and the retention member 6 are housed in a casing 7.

The recording head 2 is retained in the casing 7 by the retention member 6. The recording head 2 is retained by the retention member 6 in such a manner that the +Z-direction, which is the direction of ink droplet ejection, is slanted relative to the +G-direction, which is vertically downward (also called the direction of gravitational force). More specifically, an ejection face 100*a* where nozzles 101 of the recording head 2 are formed is provided along the XY plane defined by the X-axis and the Y-axis and is in a posture such that the ejection face 100*a* is turned about an imaginary rotational axis extending along the X-axis from a posture aligning with the horizontal plane. Specifically, the recording head 2 is retained in a slanted posture such that a +Y-direction end portion 100*b* of the ejection face 100*a* is located vertically upward of, i.e., on the −G-direction side of, a −Y-direction end portion 100*c* of the ejection face 100*a*, which is opposite from the +Y-direction end portion 100*b*. When the ejection face 100*a* is slanted this way, the +Z-direction, which is the direction in which the nozzles 101 eject ink droplets, can be slanted in the +Y-direction relative to the +G-direction. Note that the slanting angle θ of the recording head 2 relative to the +G-direction, i.e., the slanting angle θ of the +Z-direction, which is the direction of ink droplet ejection, relative to the +G-direction, is set to fall within the range of, for example, $0 \leq \theta \leq 90°$. It goes without saying that the slanting angle θ may fall within $90° < \theta \leq 180°$.

The recording head 2 is a line head elongated in the +X-direction, including a large number of nozzles 101 arranged so that their printing range in the direction along the X-axis, which is orthogonal to the transport direction of the medium S, may be equal to or larger than the printing range on the medium S in the direction along the X-axis. In other words, the recording head 2 of the present embodiment is configured such that the nozzles 101 are arranged to form a printing range which is equal to or larger than the printing range on the medium S in the direction along the X-axis, with the recording head 2 being affixed so as not to move along neither the X-axis nor the Y-axis relative to the casing 7. Such a configuration is called a line head.

In the present embodiment, a medium S is a type of a medium such as, for example, a recording sheet in a continuous form or the like, a cloth, or a resin film, and is retained while being wound on an unreel shaft 8 in a rolled form. The medium S is transported by the transport mechanism 4 onto the support platform 5, such as a platen, disposed with a space from the ejection face 100*a* where the nozzles 101 of the recording head 2 are formed, and the recording head 2 prints the medium S on the support platform 5. The ink jet recording apparatus 1 is configured such that the medium S printed by the recording head 2 on the support platform 5 is wound up on a wind-up shaft 9 by the transport mechanism 4.

The mount surface of the support platform 5 on which a medium S is mounted is disposed in a slanted manner to conform to the slanting angle of the ejection face 100*a* of the recording head 2. In other words, the mount surface of the support platform 5 is disposed along the XY plane like the ejection face 100*a*. Specifically, the slanting angles θ of the ejection face 100*a* and the support platform 5 are set so that the interspaces between the medium S and the respective nozzles 101 of the ejection face 100*a* may be constant during the printing operation. Having the same interspace between the medium S and each of the nozzles 101 on the ejection face 100*a* allows reduction in misalignment of landing positions on the medium S of ink droplets ejected from the nozzles 101. Thus, degradation in the image quality of the image or the like printed on the medium S can be reduced. Note that the medium S is not limited to one in a continuous form, and various types of ejection-target media can be employed as long as ink droplets ejected from the nozzles 101 of the recording head 2 can land thereon. For example, the present disclosure is also usable for applications where ink droplets are ejected to an ejection-target medium having a three-dimensional shape. Also, the support platform 5 is not limited to a platen having a flat mount surface on which a medium S is to be mounted, and may be, for example, a drum, or what is called a drum platen, having a curved mount surface on which a medium S is to be mounted. Alternatively, a configuration may be employed in which the backside of a medium S is supported by a transport belt such as an endless belt.

The transport mechanism 4 includes sheet feed rollers 10 and transport rollers 11. The sheet feed rollers 10 are formed by a pair of upper and lower rollers rotatable in opposite directions from each other in synchronization while nipping a medium S. The sheet feed rollers 10 are driven by power from a motor (not shown) and supply a medium S from the unreel shaft 8 side to the support platform 5 side. The transport rollers 11 are arranged on the opposite side of the support platform 5 from the sheet feed rollers 10 and guide the printed medium S to the wind-up shaft 9 side. Note that the medium S does not necessarily have to be wound up on the wind-up shaft 9. Also, in the example shown in the present embodiment, the transport mechanism 4 includes the sheet feed rollers 10 and the transport rollers 11, but the present disclosure is not limited to this. The medium S may be transported by a belt or a drum.

The liquid supply section 3 includes liquid reservoirs 12 containing ink, inlet channels 13 through which ink from the liquid reservoirs 12 are supplied to the recording head 2, and discharge channels 14 through which ink discharged from the recording head 2 is returned to the liquid reservoirs 12.

The liquid reservoirs 12 are where ink to be ejected from the recording head 2 is stored. The liquid reservoirs 12 respectively contain a plurality of kinds of ink with different colors or types. In the present embodiment, four liquid reservoirs 12 are provided within the casing 7. Examples of such a liquid reservoir 12 include a cartridge that is attachable and detachable, a pouch-shaped ink pack formed of a flexible film, and an ink tank which can be replenished with ink. Note that the number of liquid reservoirs 12 is not limited to any particular number: there may be one liquid reservoir 12 or two or more liquid reservoirs 12.

The inlet channels 13 supply ink from the liquid reservoirs 12 to the recording head 2 and are provided inside respective inlet ducts such as tubes. The inlet channels 13 are provided independently for the respective types of ink. Thus, in the present embodiment, four inlet channels 13 are provided to correspond to the four liquid reservoirs 12. Note that FIG. 1 shows the inlet channels 13 lumped as one.

A pneumatic feed means 15 is provided at a midway point on each of the inlet channels 13 to pneumatically feed ink from the liquid reservoir 12 to the recording head 2. Examples of the pneumatic feed means 15 include a press means that presses the liquid reservoir 12 from outside and a pressure pump. In the present embodiment, a pressure pump is provided as the pneumatic feed means 15. Also, for example, a hydraulic head pressure generated by adjustment of the relative positions of the recording head 2 and the liquid reservoir 12 in the vertical direction may be used as the pneumatic feed means 15.

The discharge channels 14 return ink discharged from the recording head 2 to the liquid reservoirs 12 and are provided inside respective discharge ducts such as tubes. The discharge channels 14 are provided independently for the respective types of ink. Thus, four discharge channels 14 are provided to correspond to the four liquid reservoirs 12. Note that FIG. 1 shows the discharge channels 14 lumped as one. Each discharge channel 14 may be provided with a suction means, such as a suction pump, to suck ink from the recording head 2. Also, the discharge channel 14 is not limited to one that returns ink discharged from the recording head 2 to the liquid reservoir 12, and for example, ink discharged via the discharge channel 14 may be discharged to a discharge tank separate from the liquid reservoir 12.

Figure 2:
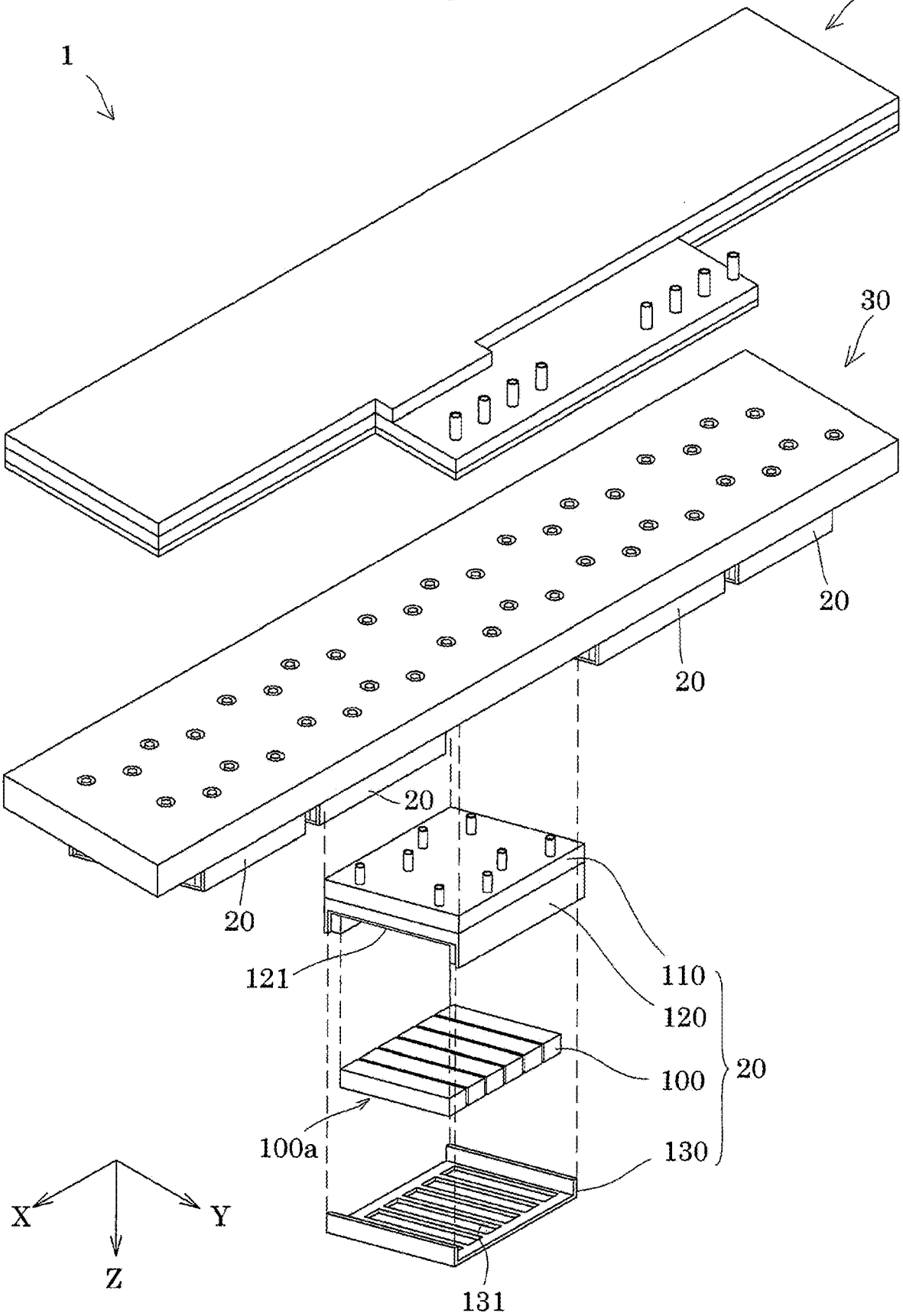
FIG. 2 is an exploded perspective view of a recording head.
Figure 3:
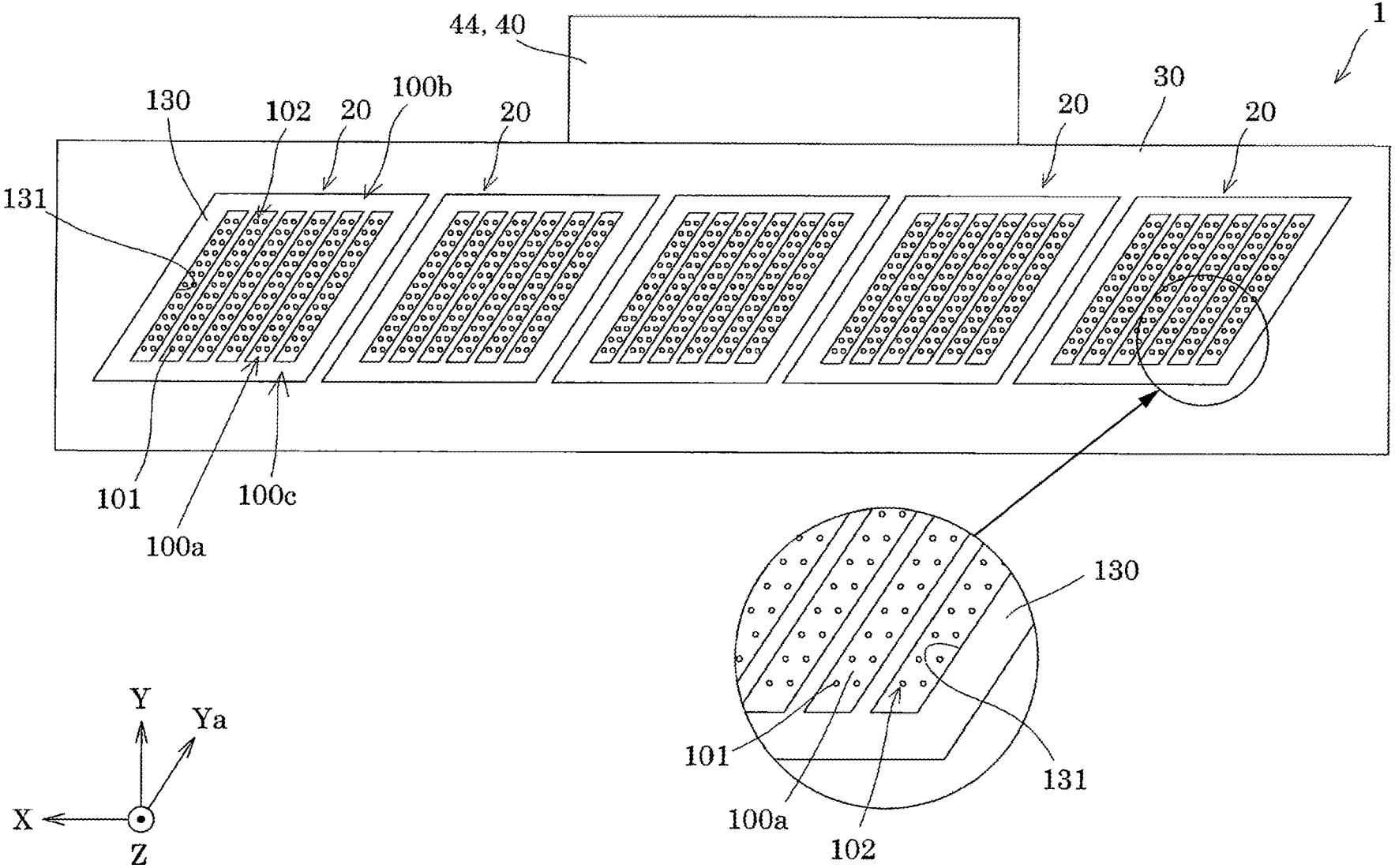
FIG. 3 is a plan view of an ejection surface of the recording head.
Figure 4:
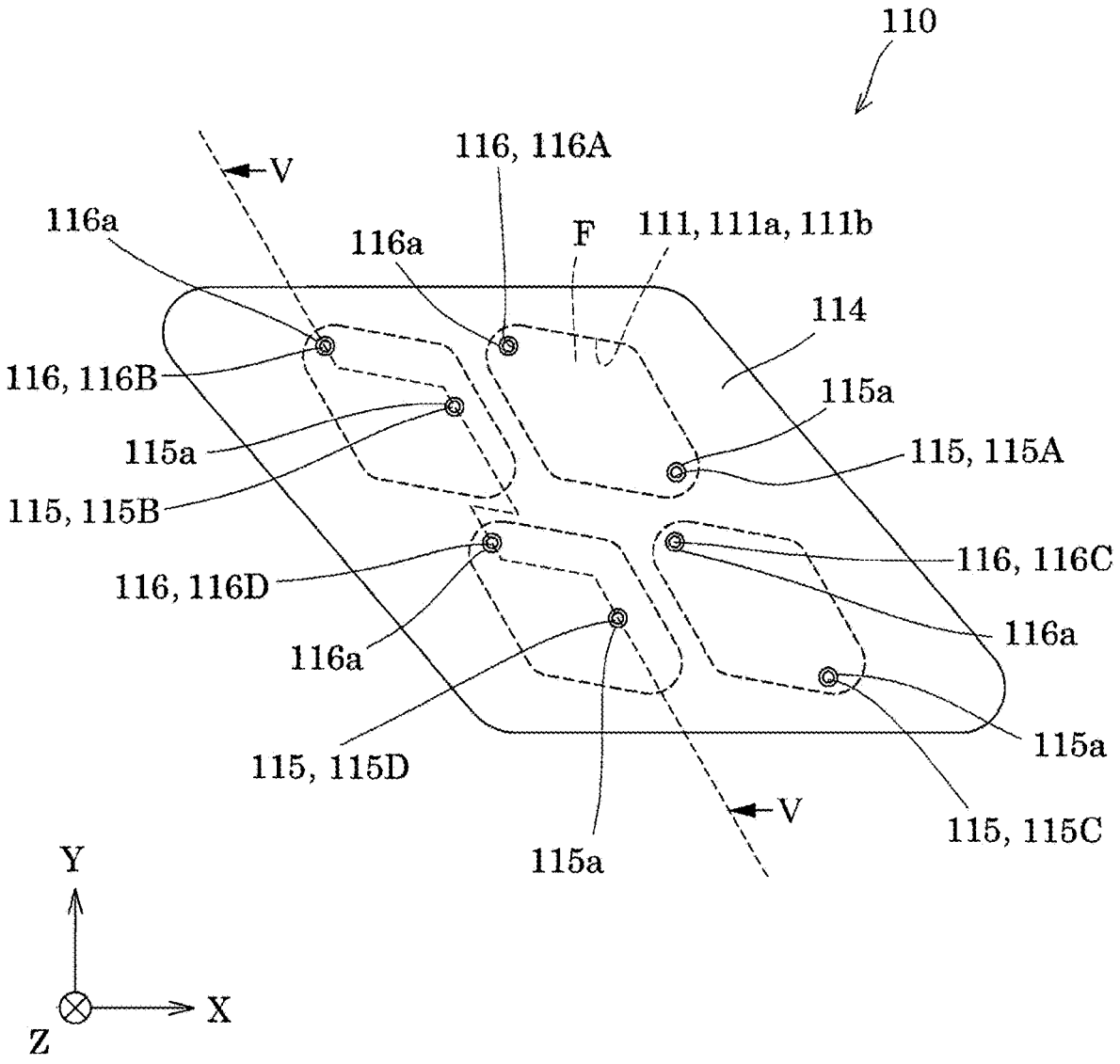
FIG. 4 is a plan view of a filter unit.
Figure 5:
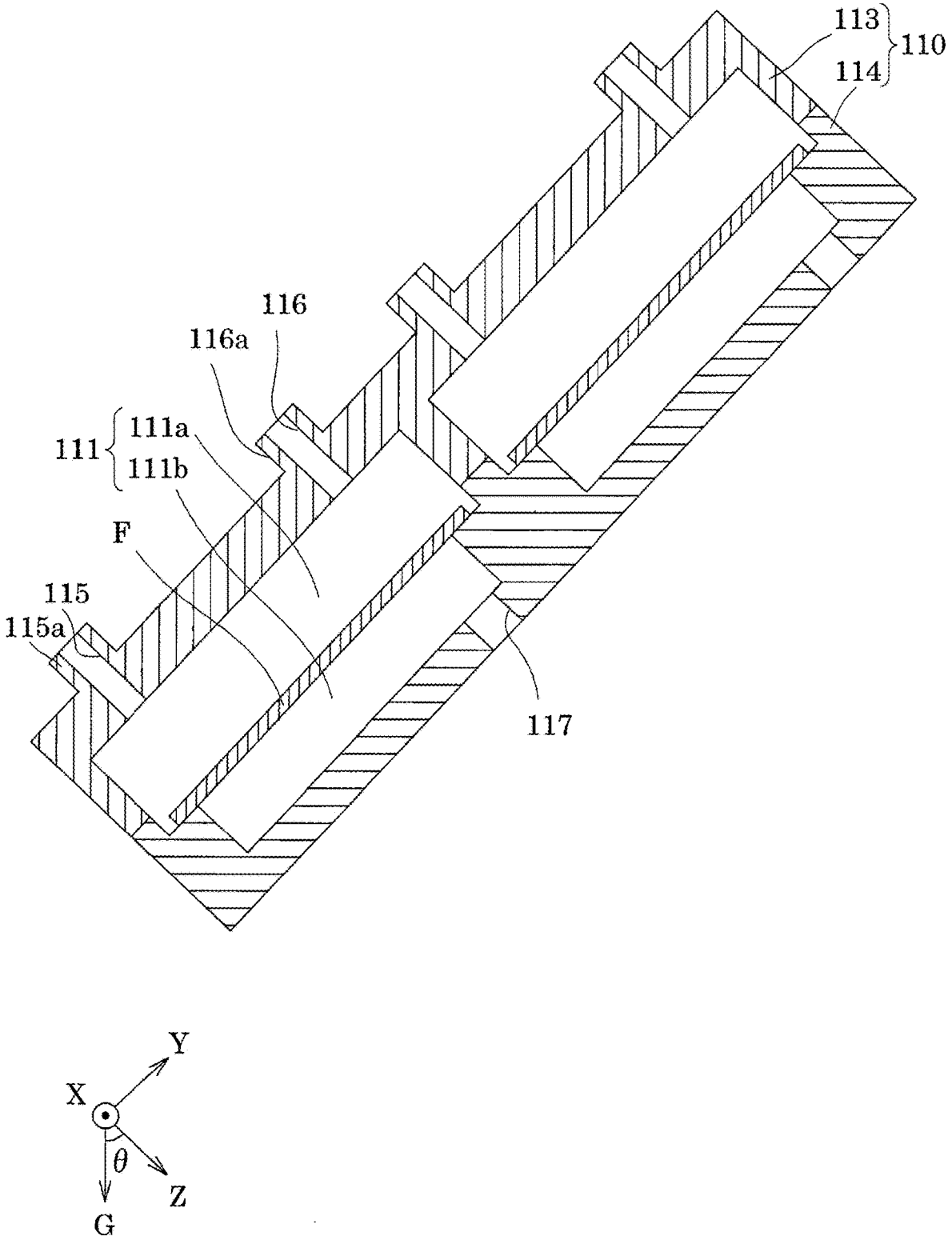
FIG. 5 is a sectional view of the filter unit.

Now, with reference to FIGS. 2 and 5, a description is given of the ink jet recording head 2 of the present embodiment, which is an example of a liquid ejecting head. FIG. 2 is an exploded perspective view of the recording head 2. FIG. 3 is a plan view of the recording head 2, showing the ejection face 100*a* side. FIG. 4 is a plan view of a filter unit 110 seen in the +Z-direction. FIG. 5 is a sectional view taken along the V-V line in FIG. 4.

As shown in FIG. 2, the recording head 2 of the present embodiment includes a plurality of head units 20, a unit base 30 retaining the plurality of head units 20, and a flow channel member 40 that supplies liquid to the plurality of head units 20.

The head units 20 are retained on the surface of the unit base 30 on the +Z-direction side, i.e., the surface facing a medium S. As to the plurality of head units 20, three or more of them are arranged side by side in the +X-direction. In the present embodiment, five head units 20 are arranged side by side in the +X-direction on one unit base 30. It goes without saying that the number of head units 20 affixed to one unit base 30 is not limited this, and there may be one head unit 20 or two or more head units 20.

Each of the head units 20 includes a plurality of head chips 100, the filter unit 110 having flow channels for ink to be supplied to the head chips 100, a holder 120 holding the plurality of head chips 100, and an affixation plate 130 provided on the ejection face 100*a* side of the plurality of head chips 100.

Each head chip 100 is provided with nozzle arrays 102 each formed by the nozzles 101 that are arranged side by side and eject ink droplets to the +Z-direction side. In the present embodiment, one head chip 100 is provided with two nozzle arrays 102. The surface of the head chip 100 where the nozzles 101 are provided is referred to as the ejection face 100*a*.

Although not shown, the inside of each head chip 100 is provided with flow channels communicating with the nozzles 101 and pressure generation means that generate a change in pressure to the ink in the flow channels. As the pressure generation means, for example, the following may be used. Specifically, a piezoelectric actuator having a piezoelectric material capable of electromechanical transduction is deformed to change the capacity of the flow channel, thereby generating a change in pressure to the ink in the flow channel and causing ink droplets to be ejected from the nozzles 101. Other pressure generation means may be employed, such as one in which heat generation elements are disposed in the flow channels to generate heat which forms bubbles which cause ink droplets to be ejected from the nozzles 101 or what is called an electrostatic actuator in which an electrostatic force is generated between a vibration plate and an electrode to deform the vibration plate and thereby cause ink droplets to be ejected from the nozzles 101.

The filter unit 110 includes, as shown in FIGS. 4 and 5, filter chambers 111 which are part of the flow channels for ink to be supplied to the head chips 100 and filters F disposed in the filter chambers 111.

Specifically, the filter unit 110 is formed by a first filter member 113 and a second filter member 114 stacked in this order in the +Z-direction.

Inside the filter unit 110, the filter chambers 111 that accommodate the filters F are provided. The filter chambers 111 are provided independently for the respective types, colors in the present embodiment, of ink to be supplied to the head units 20. Thus, four filter chambers 111 are provided in the filter unit 110. Each filter chamber 111 is provided at the interface where the first filter member 113 and the second filter member 114 are affixed to each other. The filter chamber 111 is formed by a recessed portion provided in the first filter member 113 and a recessed portion provided in the second filter member 114, brought together at their openings. In each filter chamber 111, the filter F is provided. The filter F is provided at the interface where the first filter member 113 and the second filter member 114 are affixed to each other, partitioning the filter chamber 111 into an upstream filter chamber 111*a* and a downstream filter chamber 111*b*. Specifically, the recessed portion provided in the first filter member 113 is the upstream filter chamber 111*a*, and the recessed portion provided in the second filter member 114 is the downstream filter chamber 111*b*. Note that in the head unit 20, the upstream filter chamber 111*a* refers to a chamber that is relatively far from the nozzles 101 that eject ink, and the downstream filter chamber 111*b* refers to a chamber that is relatively close to the nozzles 101.

The filters F provided in the filter chambers 111 filter ink by capturing foreign matters in the ink, such as air bubbles and dirt. The filter F may be, for example, a sheet-shaped member formed by fine weaving or knitting of fibers made of, e.g., a metal or a resin and thereby having a plurality of minute holes formed therethrough, or a plate-shaped member made of, e.g., a metal or a resin and having a plurality of minute holes formed therethrough. Also, for example, a nonwoven fabric made of, e.g., a metal or a resin may be used as the filter F.

In the filter unit 110, each filter chamber 111 is provided with a filter chamber inflow channel 115 and a filter chamber discharge channel 116 that communicate with the upstream filter chamber 111*a* and a filter chamber outflow channel 117 that communicates with the downstream filter chamber 111*b*. In the present embodiment, the filter unit 110 has four filter chambers 111 and can therefore support four kinds of ink. It goes without saying that the filter chambers 111 may be configured such that the same kind (e.g., color) of ink flows therethrough.

The filter unit 110 has filter chamber inflow channels 115A, 115B, 115C, 115D corresponding to the four filter chambers 111. The filter chamber inflow channels 115A, 115B, 115C, 115D are referred to as the filter chamber inflow channels 115 when no distinction needs to be made. The filter chamber inflow channels 115A, 115B, 115C, 115D are disposed at positions different from one another with respect to the Y-axis. Specifically, among the filter chamber inflow channels 115, the filter chamber inflow channel 115A is disposed farthest in the +Y-direction, the filter chamber inflow channel 115B is disposed farthest in the +Y-direction except for the filter chamber inflow channel 115A, the filter chamber inflow channel 115C is disposed farthest in the −Y-direction except for the filter chamber inflow channel 115D, and the filter chamber inflow channel 115D is disposed farthest in the −Y-direction. The plurality of filter chamber inflow channels 115A in the respective plurality of head units 20 are located at the same position with respect to the Y-axis, the plurality of filter chamber inflow channels 115B in the respective plurality of head units 20 are located at the same position with respect to the Y-axis, the plurality of filter chamber inflow channels 115C in the respective plurality of head units 20 are located at the same position with respect to the Y-axis, and the plurality of filter chamber inflow channels 115D in the respective plurality of head units 20 are located at the same position with respect to the Y-axis.

The filter unit 110 also has filter chamber discharge channels 116A, 116B, 116C, 116D corresponding to the four filter chambers 111. The filter chamber discharge channels 116A, 116B, 116C, 116D are referred to as the filter chamber discharge channels 116 when no distinction needs to be made. Among the filter chamber discharge channels 116, the filter chamber discharge channel 116A and the filter chamber discharge channel 116B are disposed at substantially the same positions with respect to the Y-axis and are disposed on the +Y-direction side relative to the filter chamber discharge channel 116C and the filter chamber discharge channel 116D. The filter chamber discharge channel 116C and the filter chamber discharge channel 116D are disposed at substantially the same positions with respect to the Y-axis. Also, the plurality of filter chamber discharge channels 116A in the respective plurality of head units 20 are located at the same positions with respect to the Y-axis, the plurality of filter chamber discharge channels 116B in the respective plurality of head units 20 are located at the same positions with respect to the Y-axis, the plurality of filter chamber discharge channels 116C in the respective plurality of head units 20 are located at the same positions with respect to the Y-axis, and the plurality of filter chamber discharge channels 116D in the respective plurality of head units 20 are located at the same positions with respect to the Y-axis.

The filter chamber inflow channel 115 is a flow channel through which ink is supplied into the filter chamber 111 and is provided to extend along the Z-axis such that its one end is open on the bottom surface of the recessed portion forming the upstream filter chamber 111*a*, i.e., the surface of the recessed portion on the +Z-direction side and its other end is open at a −Z-direction tip end of a filter chamber inflow channel protrusion portion 115*a* provided to protrude from the surface of the first filter member 113 on the −Z-direction side.

The filter chamber discharge channel 116 is a flow channel through which ink in the filter chamber 111 is discharged to the outside and is provided to extend along the Z-axis such that its one end is open on the bottom surface of the recessed portion forming the upstream filter chamber 111*a* and its other end is open at a −Z-direction tip end of a filter chamber discharge channel protrusion portion 116*a* provided to protrude from the surface of the first filter member 113 on the −Z-direction side.

The filter chamber outflow channel 117 is a flow channel through which ink in the filter chamber 111 flows out to the head chips 100 via the holder 120 and is provided such that its one end is open on the bottom surface of the recessed portion forming the downstream filter chamber 111*b*, i.e., the surface of the recessed portion on the −Z-direction side.

Ink supplied from the filter chamber inflow channel 115 to the upstream filter chamber 111*a* is filtered by the filter F, passes through the downstream filter chamber 111*b* and then through the filter chamber outflow channel 117, and is supplied to the plurality of head chips 100 via the holder 120. Also, ink supplied to the upstream filter chamber 111*a* through the filter chamber inflow channel 115 and air bubbles in the filter chamber 111 are discharged to the outside of the head unit 20 through the filter chamber discharge channel 116.

The filter F is disposed to be parallel with the ejection face 100*a* where the nozzles 101 are formed. Thus, the slanting angle of the filter F, i.e., the slanting angle of the direction perpendicular to the filter F relative to the vertically downward +G-direction is the same as the slanting angle of the ejection face 100*a*.

The filter chamber 111 has a substantially rhombus shape in a plan view seen in the +Z-direction which is perpendicular to the filter F. The opening of the filter chamber discharge channel 116 into the filter chamber 111 is disposed at a position vertically upward of the opening of the filter chamber inflow channel 115 into the filter chamber 111 when the head unit 20 is in a posture such that its +Y-direction end portion is located vertically upward of its −Y-direction end portion. In other words, during use, the head unit 20 in the ink jet recording apparatus 1 is in a posture such that its +Y-direction end portion is vertically upward and its −Y-direction end portion is vertically downward. Thus, the filter chamber discharge channel 116 is disposed farther in the +Y-direction than the filter chamber inflow channel 115. Thus, when the head unit 20 is slanted such that the +Y-direction end portion 100*b* of the ejection face 100*a* is vertically upward of, i.e., on the −G-direction side of, the −Y direction end portion 100*c*, the filter chamber discharge channel 116 is disposed vertically upward of the filter chamber inflow channel 115. Owing to the filter chamber discharge channel 116 being thus disposed upward of the filter chamber inflow channel 115 in the direction of gravitational force, when ink is supplied through the filter chamber inflow channel 115, air bubbles in the filter chamber 111 can buoyantly move vertically upward and be expelled to the outside easily through the filter chamber discharge channel 116. The improvement in the performance for expelling air bubbles in the filter chamber 111 can help prevent the filter F from having a reduced effective area due to air bubbles remaining in the filter chamber 111 and prevent ink-droplet ejection failure in the head chips 100 due to air bubbles in the filter chamber 111 moving to the head chips 100 side at unexpected timing. It goes without saying that the positions of the filter chamber inflow channel 115 and the filter chamber discharge channel 116 are not limited to the above.

The holder 120 has a holding portion 121 defining a groove-shaped space on the +Z-direction side. The holding portion 121 is provided continuously over the +Z-side surface of the holder 120 in the direction along the Y-axis, so that the holding portion 121 is open at both the +X-direction side surface and the −X-direction side surface. Inside the holding portion 121 of the holder 120, the plurality of head chips 100 are arranged side by side in the +X-direction and are affixed with an adhesive or the like. In the present embodiment, six head chips 100 are affixed to one holder 120. It goes without saying that the number of head chips 100 affixed to one holder 120 is not limited to the above, and only one head chip 100 or two or more head chips 100 may be affixed to one holder 120.

Although not shown, the inside of the holder 120 is provided with flow channels whose one ends communicate with the filter chamber outflow channels 117 of the filter unit 110. In other words, the holder 120 is provided with flow channels corresponding to the respective filter chamber outflow channels 117. Since four filter chamber outflow channels 117 are provided in the present embodiment, four flow channels are independently provided inside the holder 120. At a midway point on each of the flow channels provided inside the holder 120, the flow channel branches into as many distributes as the head chips 100, six in the present embodiment. The other ends of the six distributes of each of the flow channels provided inside the holder 120 are open on the bottom surface of the holding portion 121 of the holder 120, i.e., the surface on the +Z-direction side and communicate with the flow channels in the head chips 100.

In the present embodiment, the plurality of head chips 100 are affixed such that in the in-plane direction of the ejection face 100*a*, the nozzle arrays 102 are slanted relative to the +Y-direction. In other words, a +Ya direction which is a direction in which the nozzles 101 forming the nozzle array 102 are arranged side by side is slanted relative to the +Y-direction. Specifically, the plurality of nozzles 101 are arranged in the +Ya direction on the XYa plane defined by the +Ya-direction and the +X-direction intersecting with the +Ya-direction. In the present embodiment, one nozzle array 102 is divided into two parts in the +Ya-direction so that four kinds of ink can be ejected from one head chip 100.

The affixation plate 130 is, as shown in FIGS. 2 and 3, formed by bending a plate-shaped member made of a metal or the like and is provided with exposure opening portions 131 which are through-holes for exposing the nozzles 101 of the head chips 100. In the present embodiment, the exposure opening portions 131 are provided to open independently for the respective head chips 100. In other words, since each head unit 20 has six head chips 100 in the present embodiment, the affixation plate 130 is provided with six independent exposure opening portions 131.

The affixation plate 130 is bonded to the holder 120 and the plurality of head chips 100 with an adhesive. With the affixation plate 130 being bonded to the holder 120, the ejection face 100*a* and the nozzles 101 of each head chip 100 are exposed through the corresponding exposure opening portion 131 in a plan view seen from the ejection face 100*a* side.

Although the head unit 20 in the present embodiment is substantially parallelogrammatic in a plan view seen from the ejection face 100*a* side, the head unit 20 is not limited to being substantially parallelogrammatic, and may be rectangular, trapezoidal, polygonal, or the like.

Figure 6:
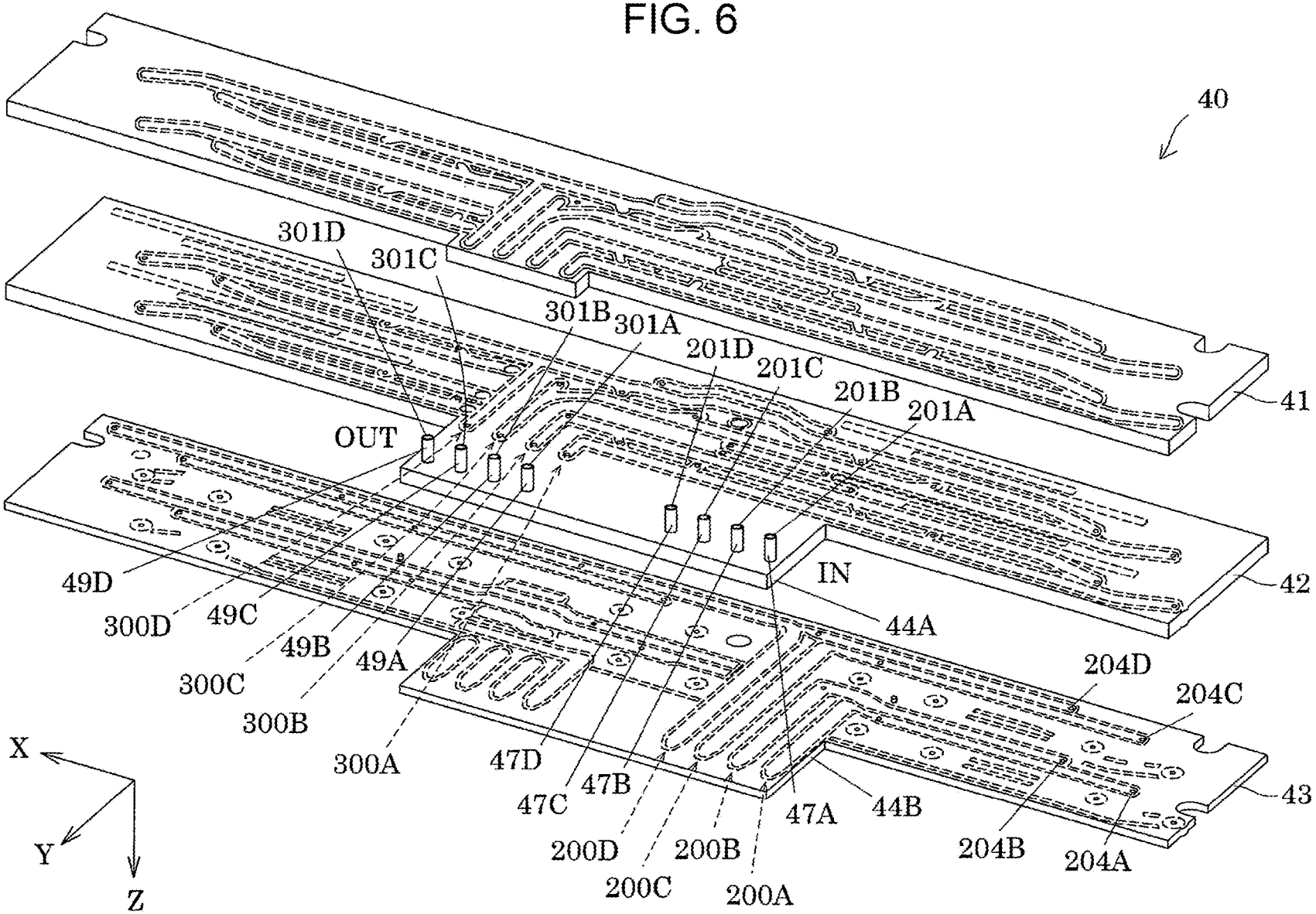
FIG. 6 is an exploded perspective view of a flow channel member.
Figure 7:
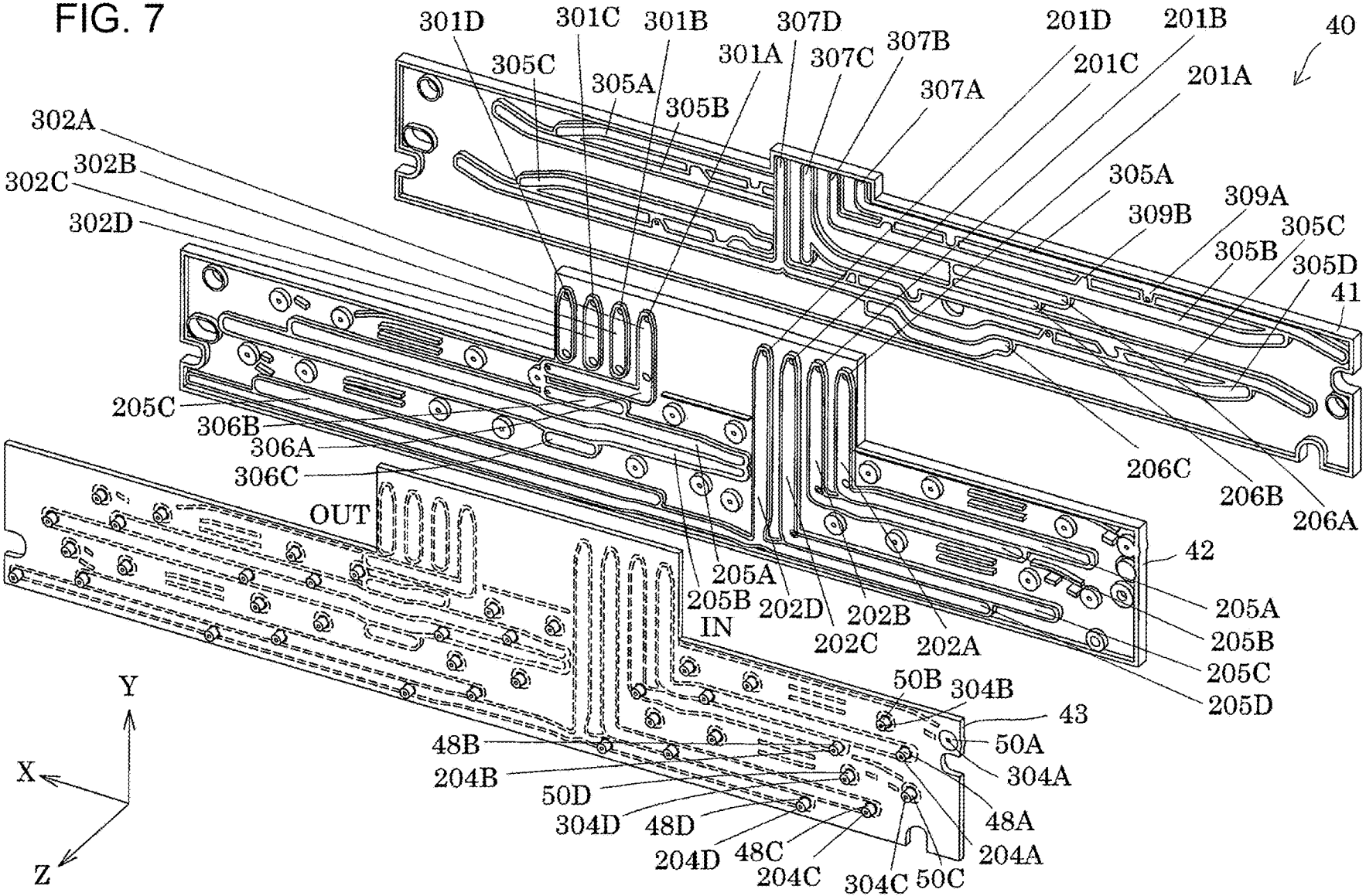
FIG. 7 is an exploded perspective view of the flow channel member.
Figure 8:
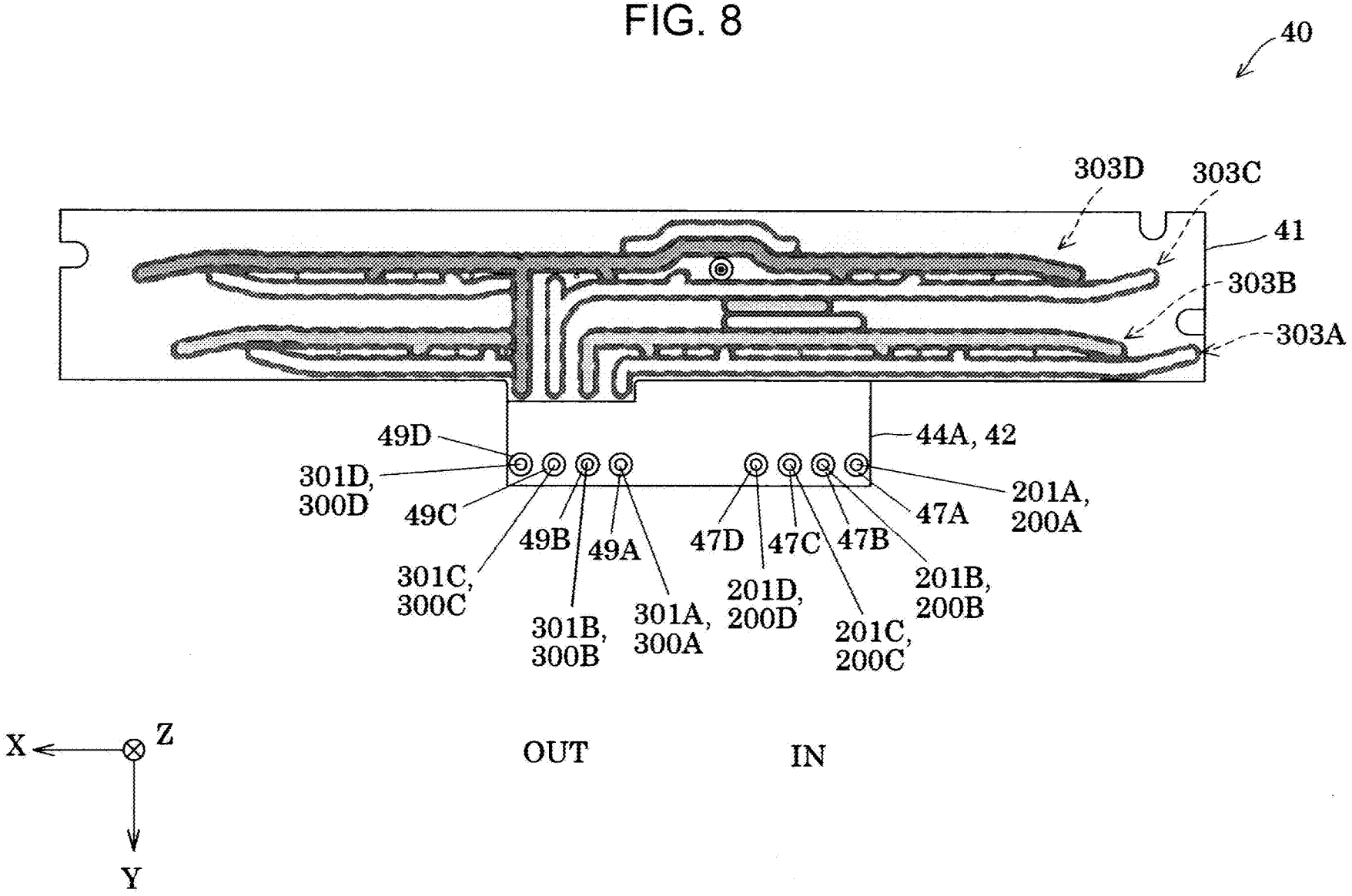
FIG. 8 is a plan view of the flow channel member.
Figure 9:
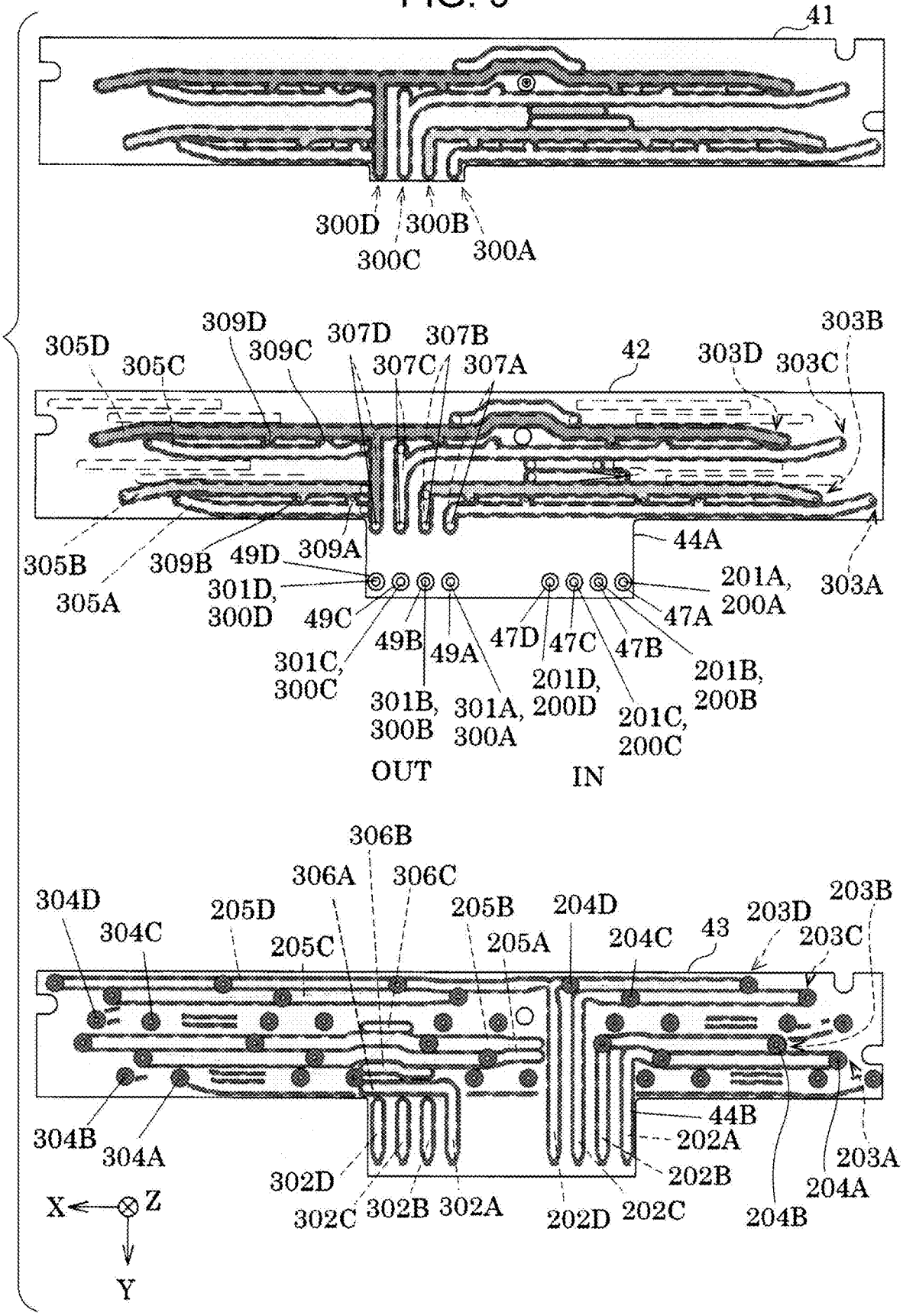
FIG. 9 is a plan view of a first flow channel member, a second flow channel member, and a third flow channel member.
Figure 10:
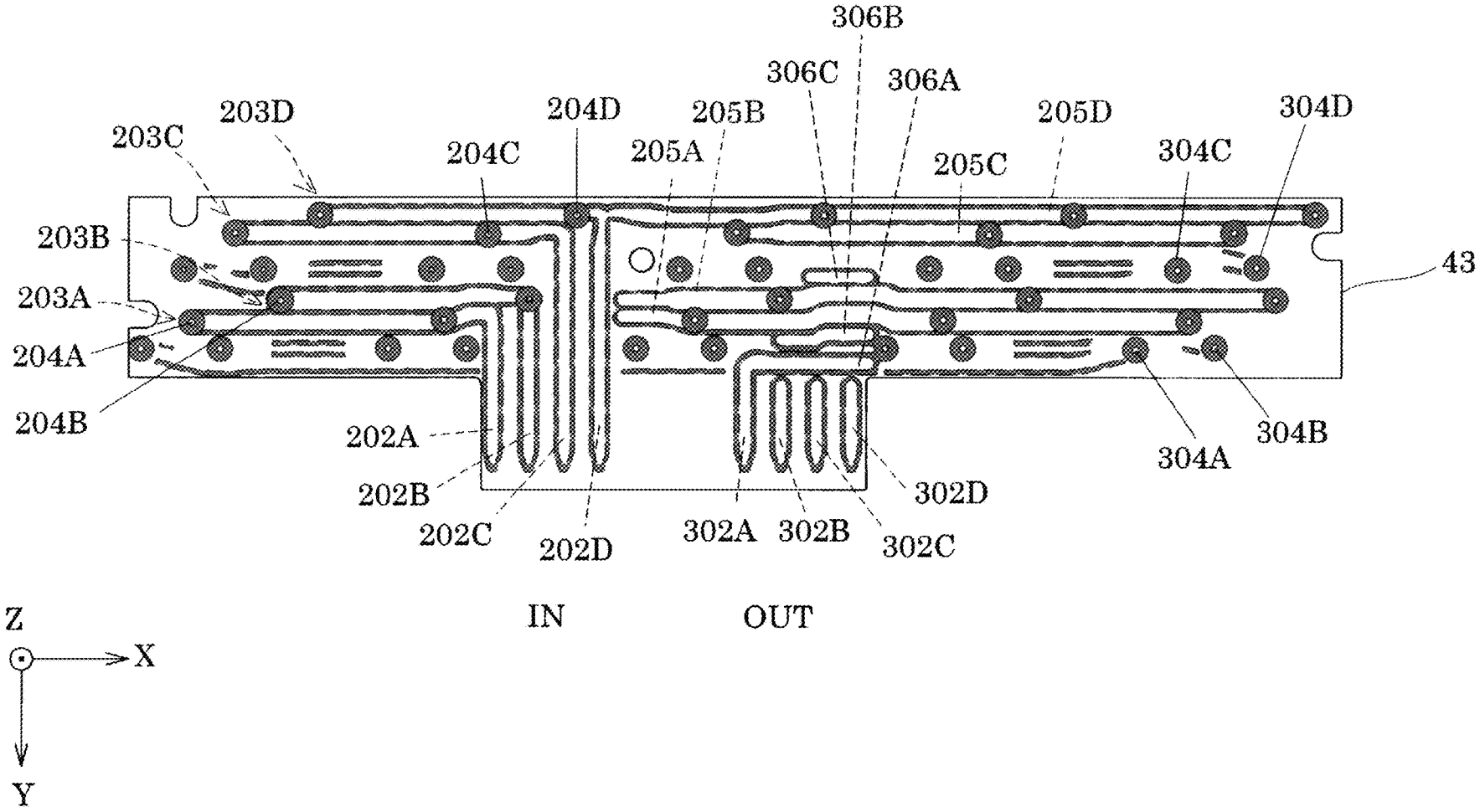
FIG. 10 is a plan view of the flow channel member.
Figure 11:
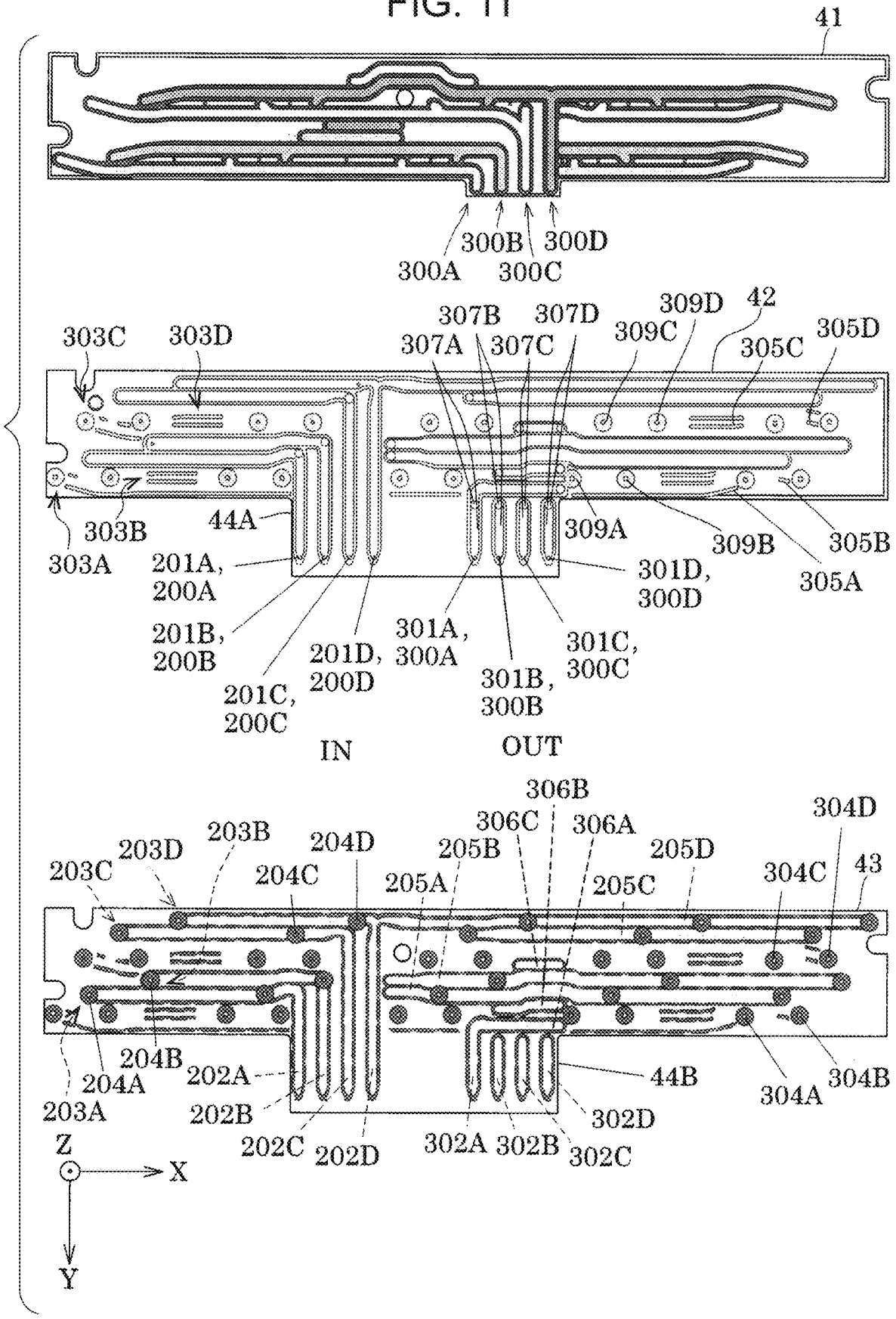
FIG. 11 is a plan view of the first flow channel member, the second flow channel member, and the third flow channel member.
Figure 12:
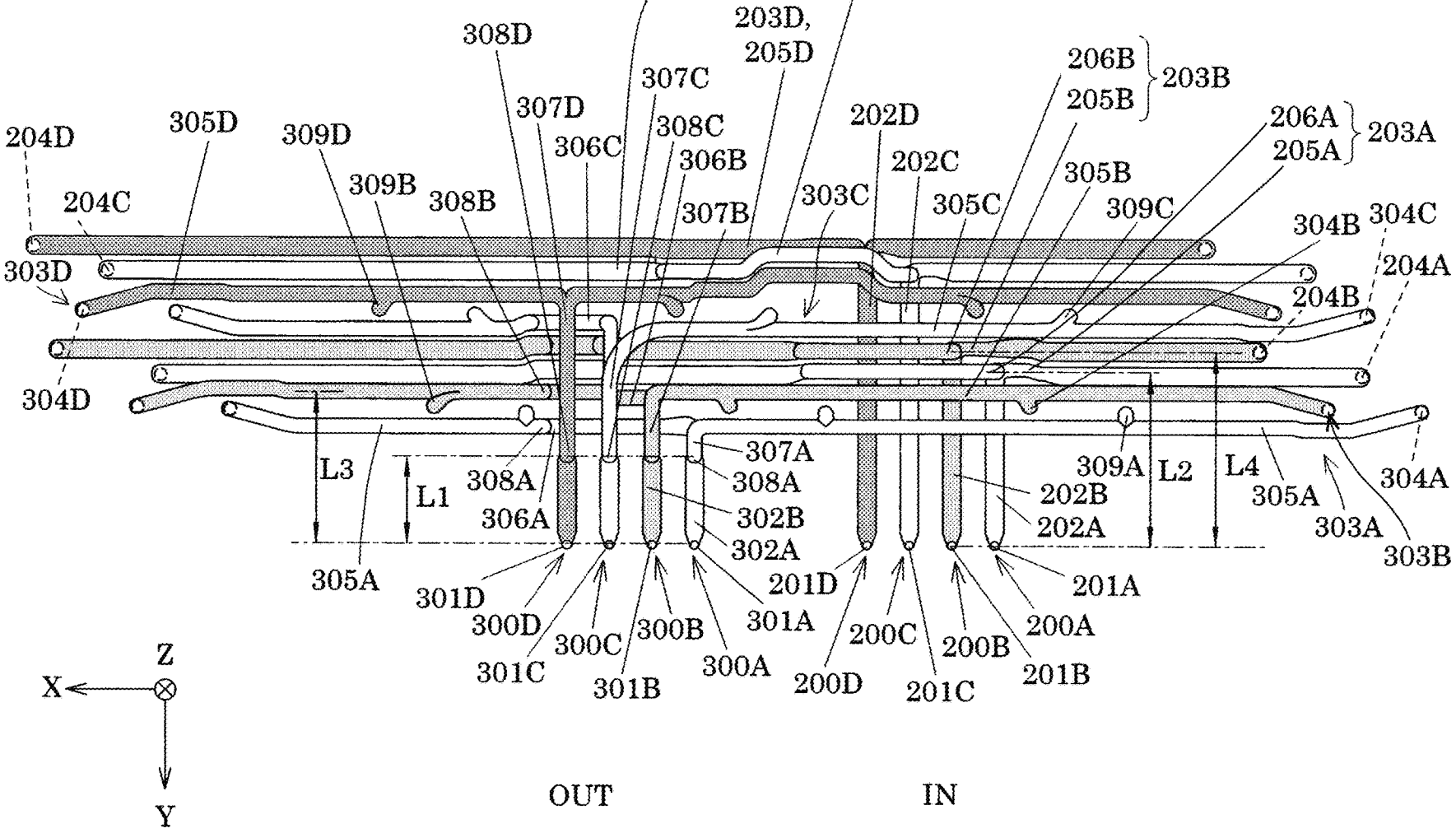
FIG. 12 is a plan view of inlet portions, supply flow channels, outlet portions, and collection flow channels.
Figure 13:
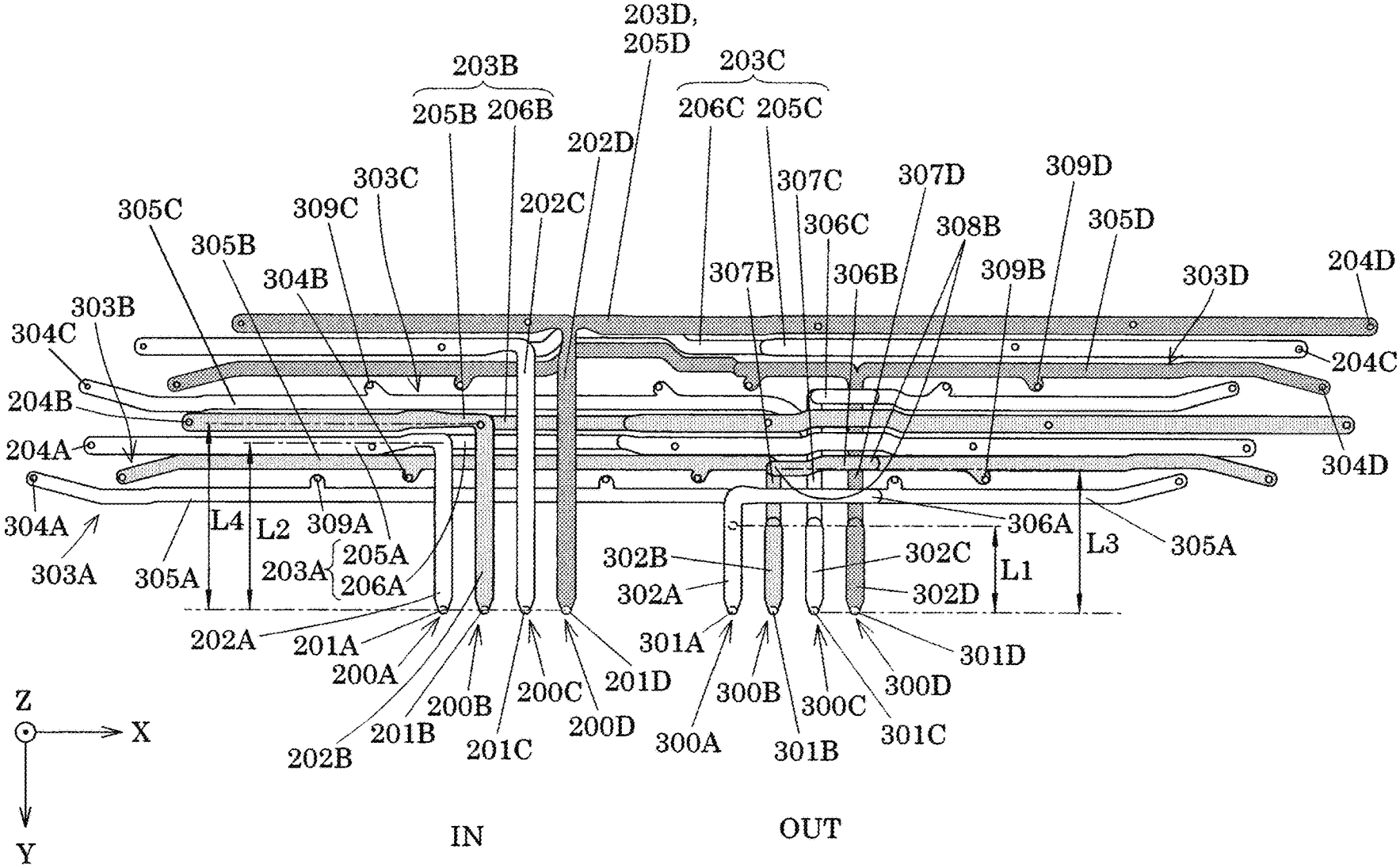
FIG. 13 is a plan view of the inlet portions, the supply flow channels, the outlet portions, and the collection flow channels.
Figure 14:
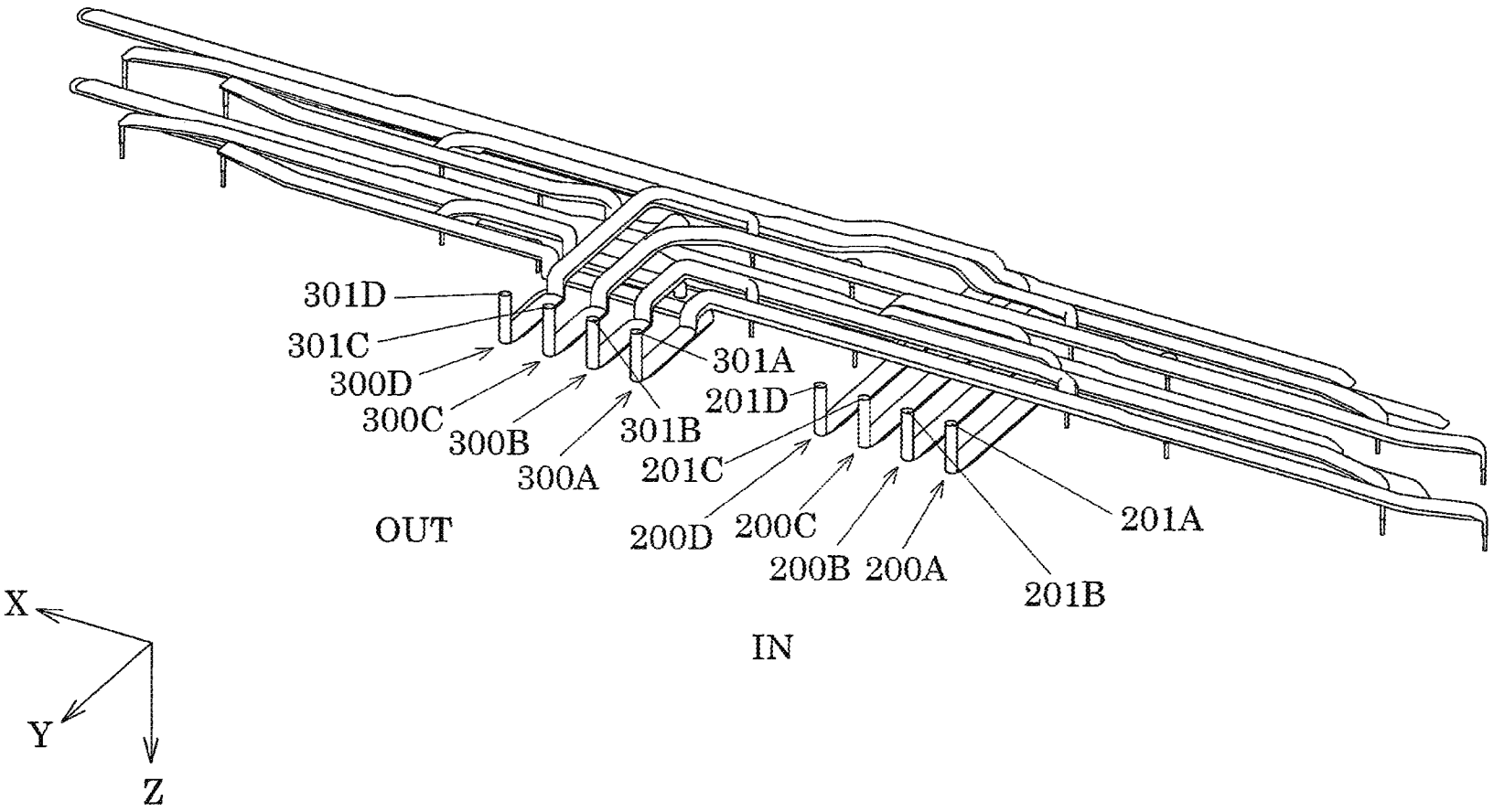
FIG. 14 is a perspective view of the inlet portions, the supply flow channels, the outlet portions, and the collection flow channels.
Figure 15:
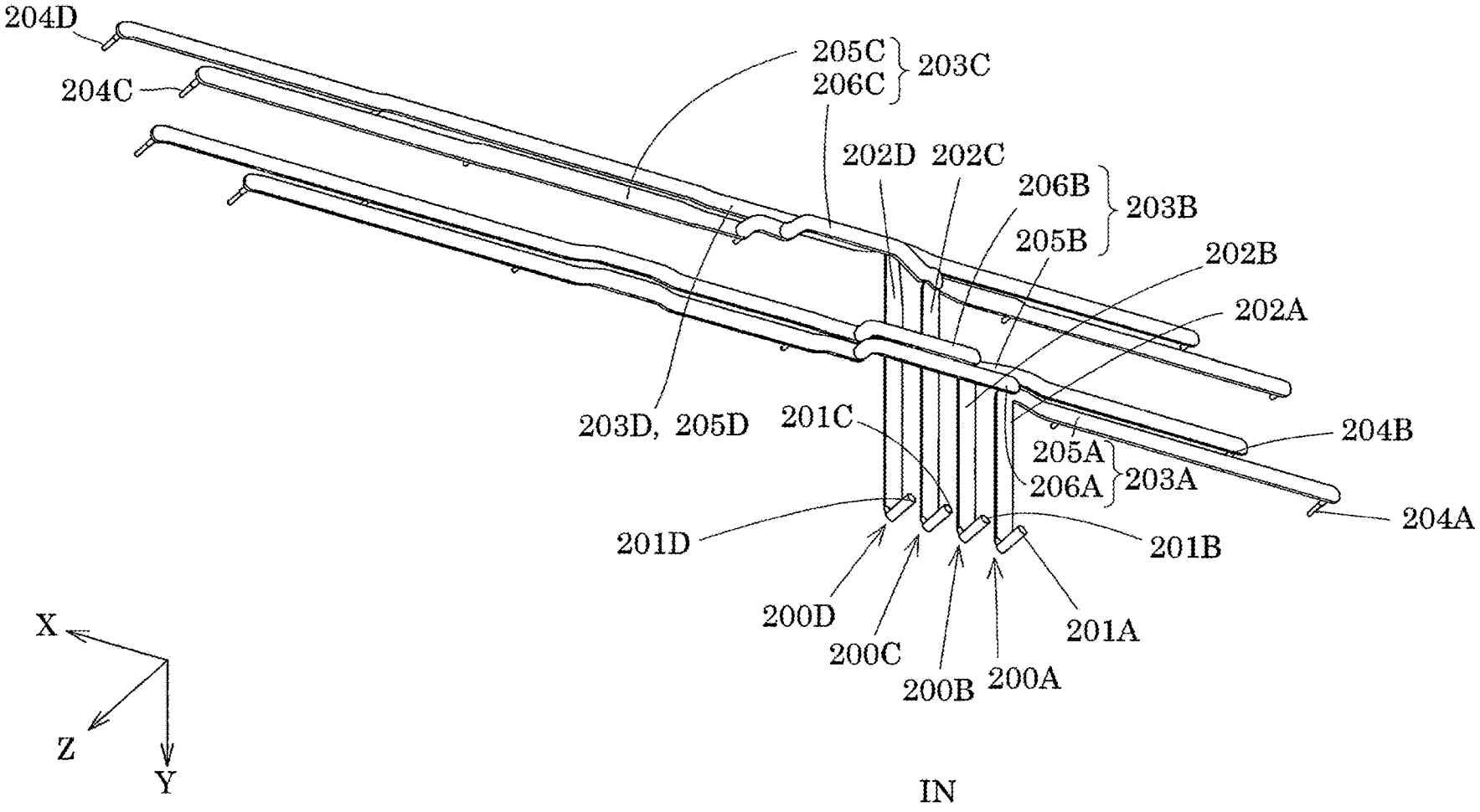
FIG. 15 is a perspective view of the inlet portions and the supply flow channels.
Figure 16:
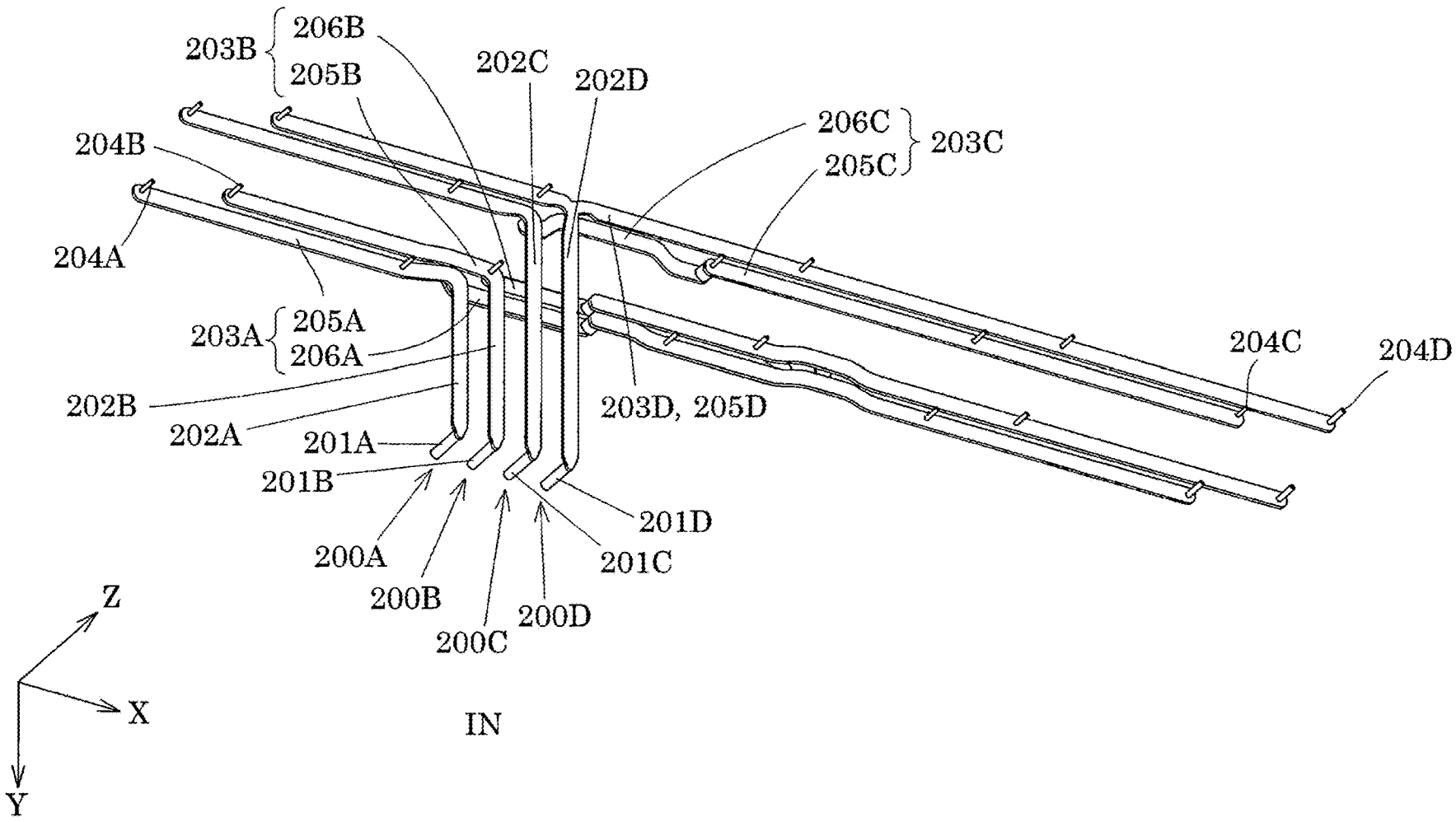
FIG. 16 is a perspective view of the inlet portions and the supply flow channels.
Figure 17:
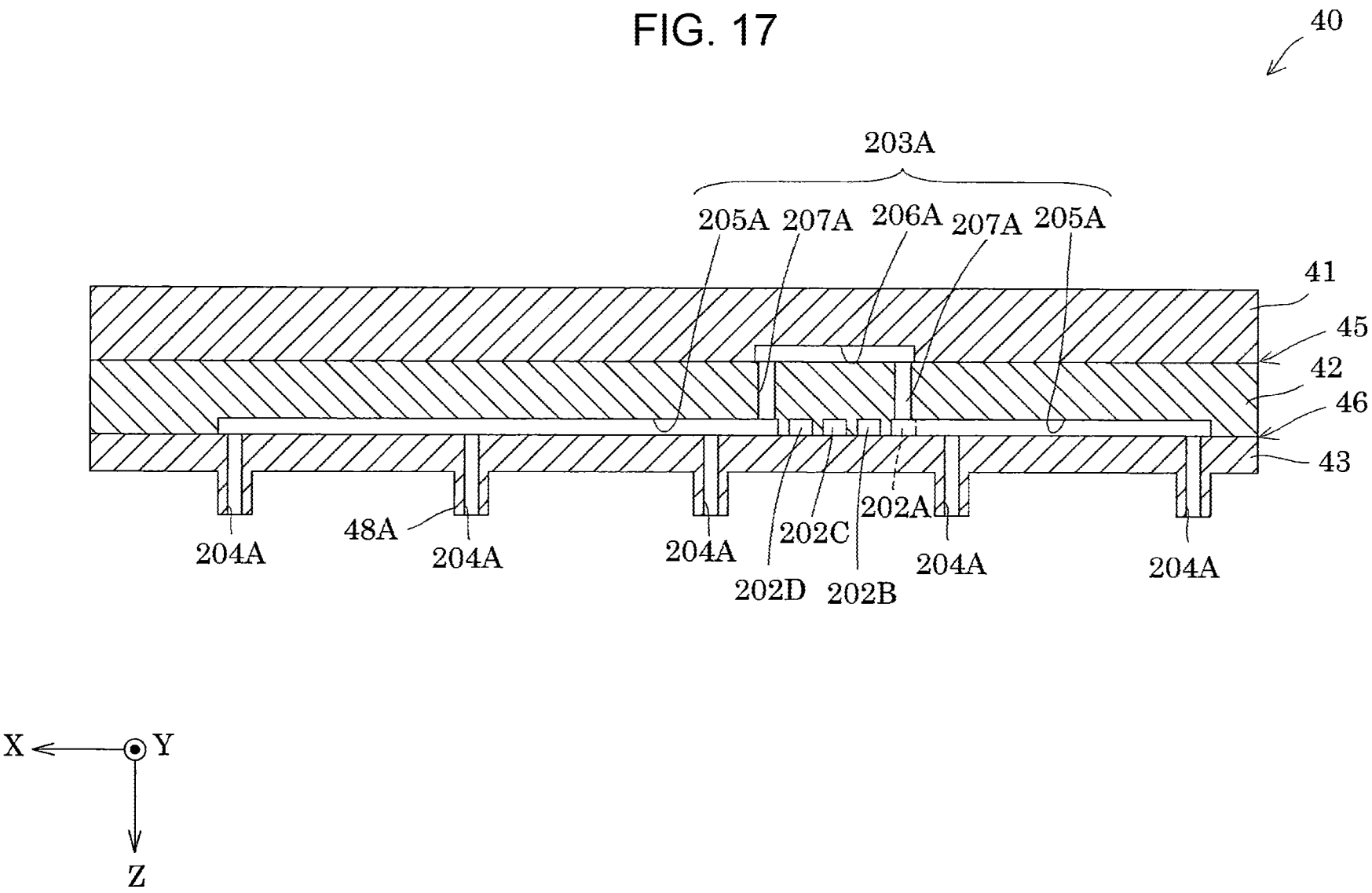
FIG. 17 is a sectional view of a main part of the flow channel member, illustrating a first supply flow channel.
Figure 18:
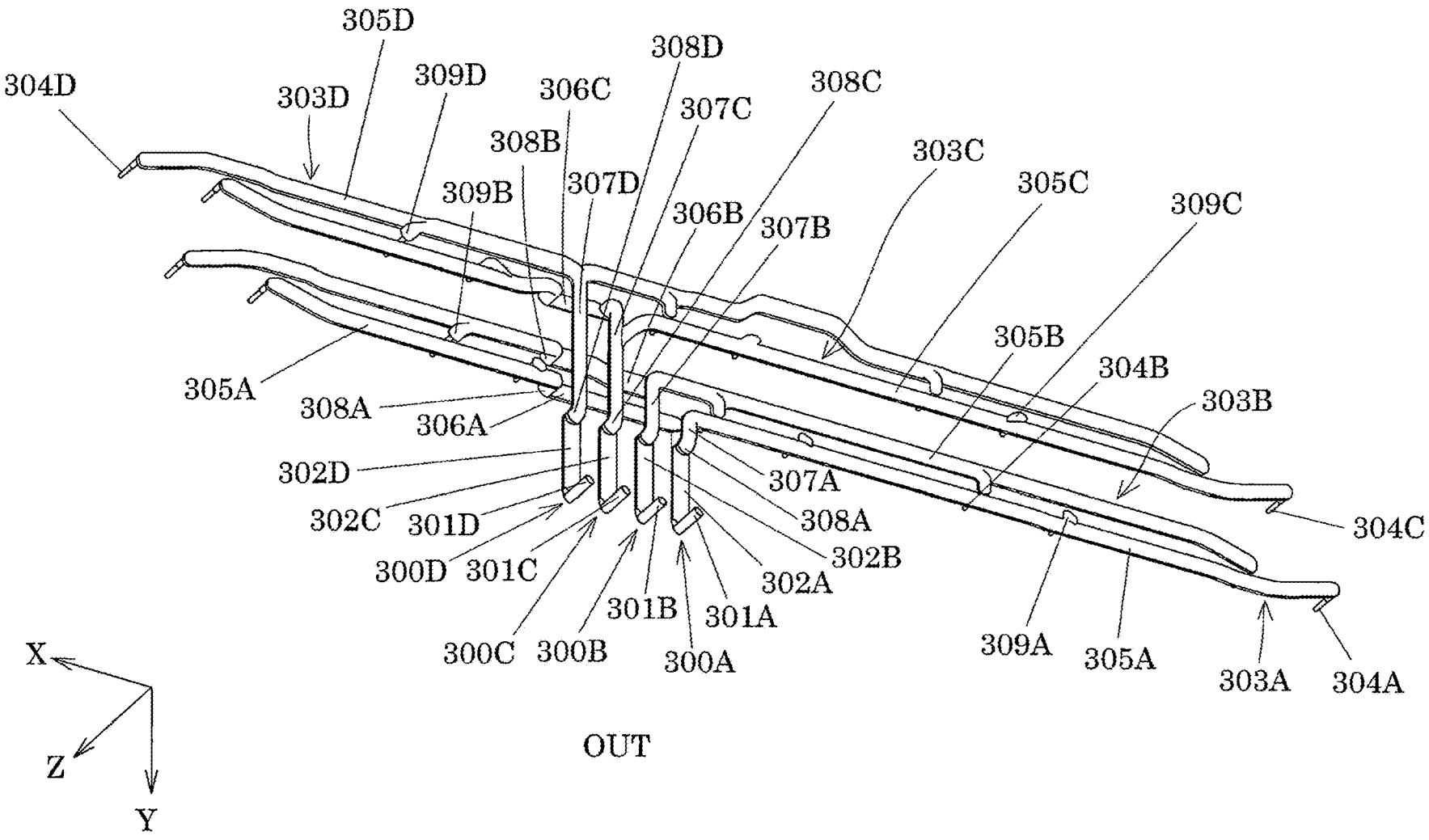
FIG. 18 is a perspective view of the outlet portions and the collection flow channels.
Figure 19:
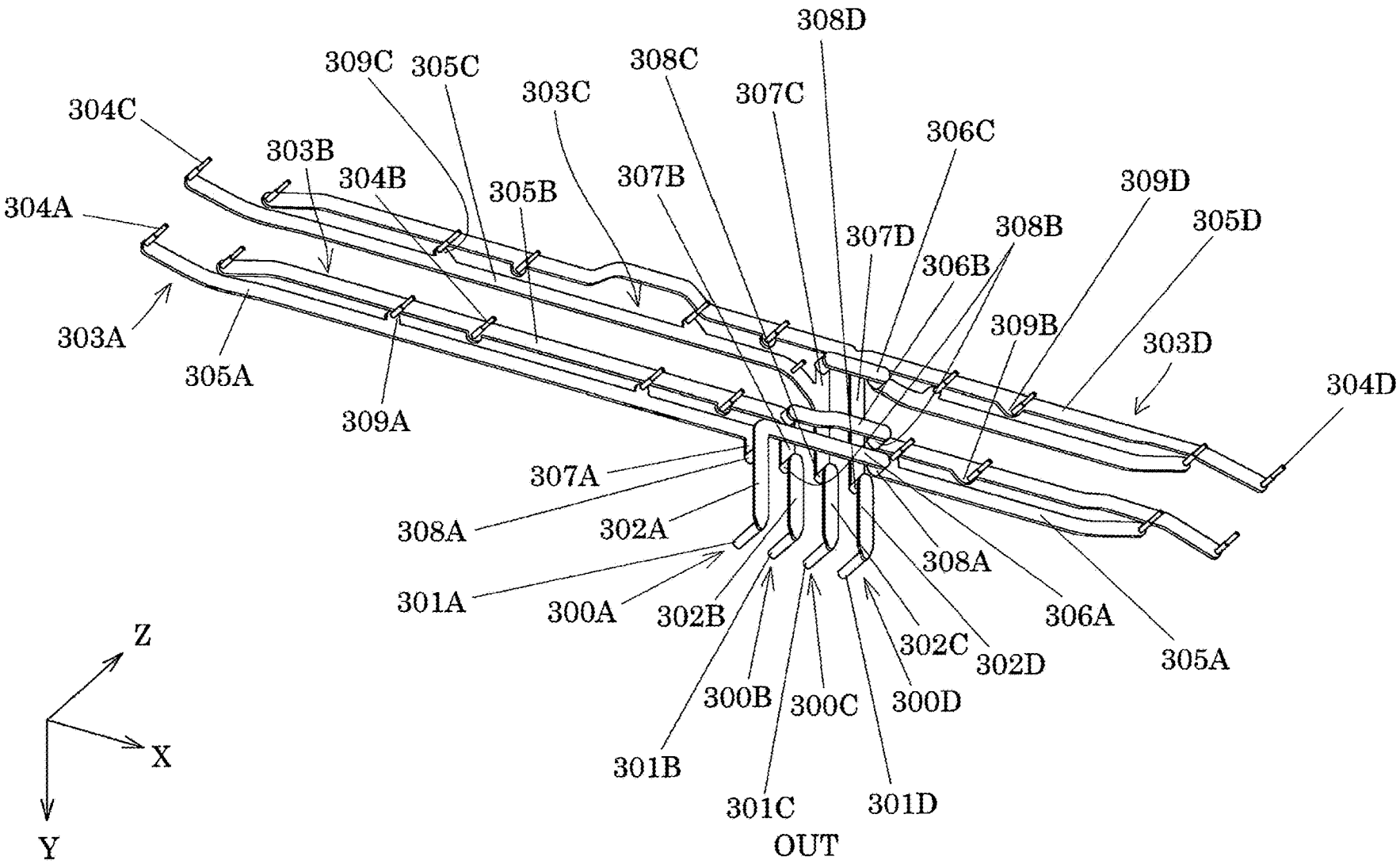
FIG. 19 is a perspective view of the outlet portions and the collection flow channels.
Figure 20:
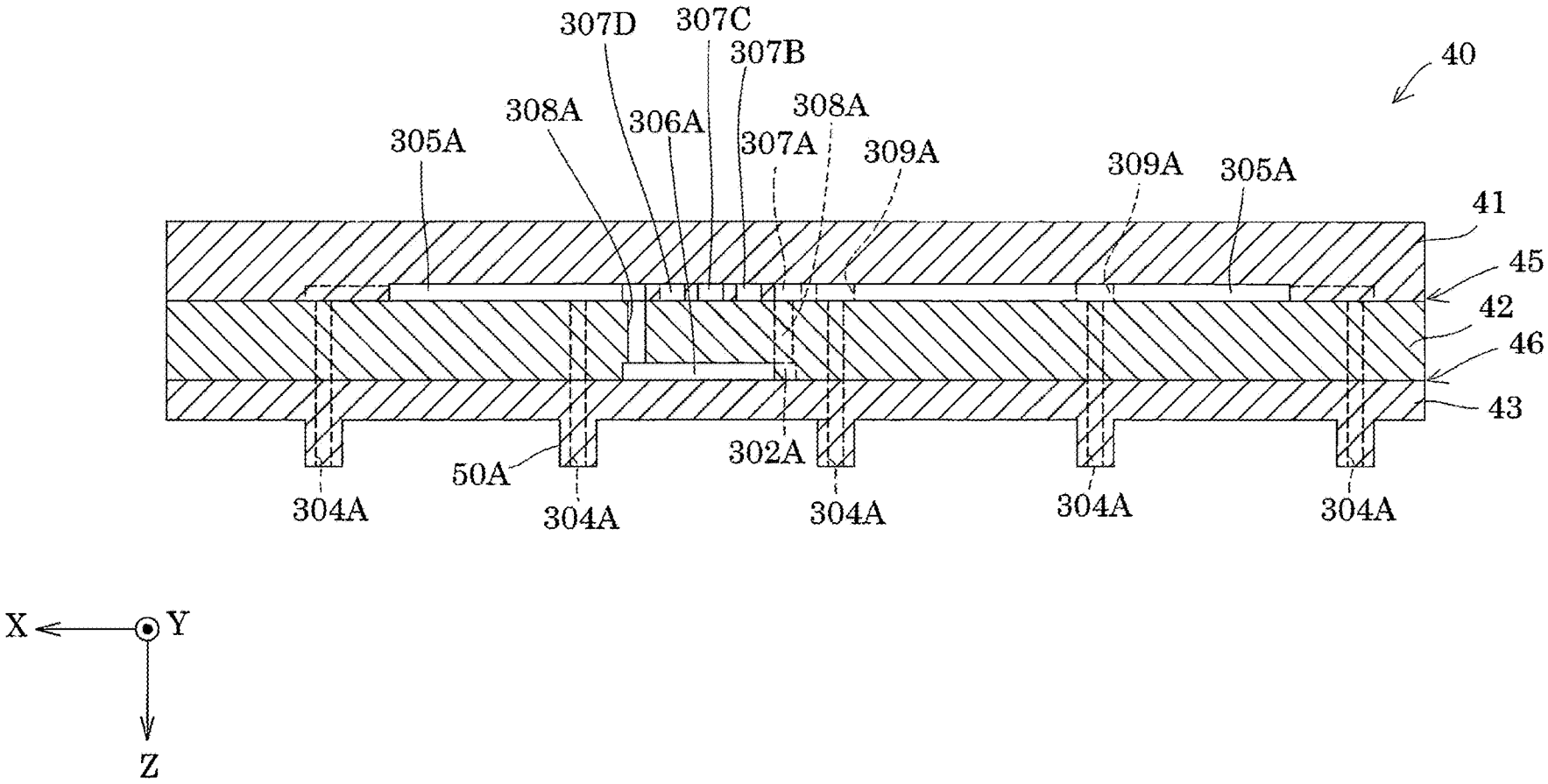
FIG. 20 is a sectional view of the flow channel member, illustrating a first collection flow channel.
Figure 21:
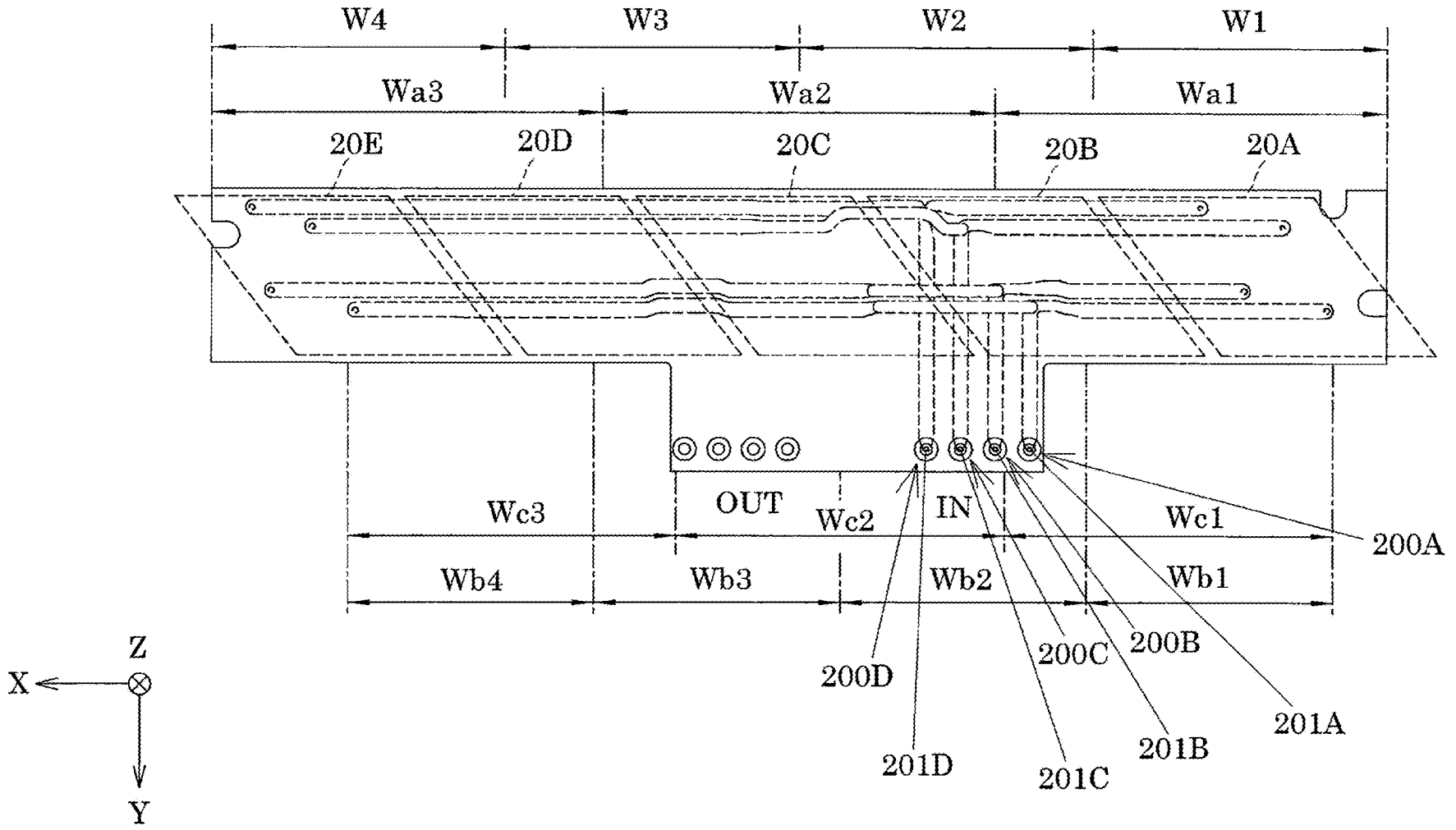
FIG. 21 is a plan view of the flow channel member, illustrating the positions of the inlet portions.
Figure 22:
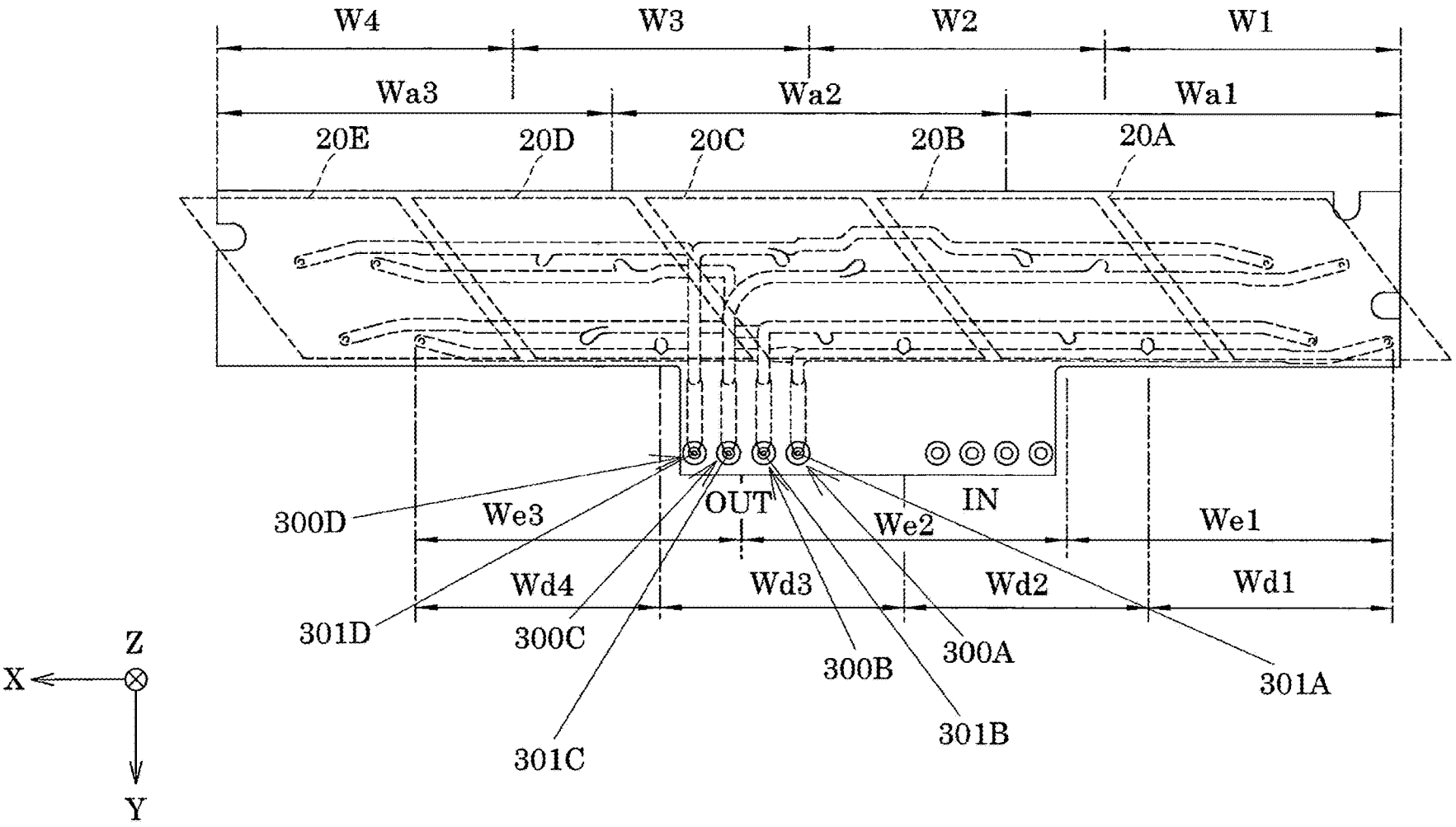
FIG. 22 is a plan view of the flow channel member, illustrating the positions of the outlet portions.

Now, the flow channel member 40 of the recording head 2 of the present embodiment is described with additional reference to FIGS. 6 to 22. FIG. 6 is an exploded perspective view of the flow channel member 40 seen in the +Z-direction. FIG. 7 is an exploded perspective view of the flow channel member 40 seen in the −Z-direction. FIG. 8 is a plan view of the flow channel member 40 seen in the +Z-direction. FIG. 9 is a plan view of a first flow channel member 41, a second flow channel member 42, and a third flow channel member 43 seen in the +Z-direction. FIG. 10 is a plan view of the flow channel member 40 seen in the −Z-direction. FIG. 11 is a plan view of the first flow channel member 41, the second flow channel member 42, and the third flow channel member 43 seen in the −Z-direction. FIG. 12 is a plan view of supply flow channels 200 and collection flow channels 300 seen in the +Z-direction. FIG. 13 is a plan view of the supply flow channels 200 and the collection flow channels 300 seen in the −Z-direction. FIG. 14 is a perspective view of the supply flow channels 200 and the collection flow channels 300 seen in the +Z-direction. FIG. 15 is a perspective view of the supply flow channels 200 seen in the +Z-direction. FIG. 16 is a perspective view of the supply flow channels 200 seen in the −Z-direction. FIG. 17 is a sectional view of a main part of the flow channel member 40, showing a first supply flow channel 200A. FIG. 18 is a perspective view of the collection flow channels 300 seen in the +Z-direction. FIG. 19 is a perspective view of the collection flow channels 300 seen in the −Z-direction. FIG. 20 is a sectional view of a main part of the flow channel member 40, showing a first collection flow channel 300A. FIGS. 21 and 22 are plan views illustrating the positions of inlet portions and collection portions.

As shown, the flow channel member 40 includes the first flow channel member 41, the second flow channel member 42, and the third flow channel member 43. The third flow channel member 43, the second flow channel member 42, and the first flow channel member 41 are stacked in this order from the head units 20 side to the −Z-direction side and are affixed to one each other with an adhesive or the like. Note that the method for affixing the first flow channel member 41, the second flow channel member 42, and the third flow channel member 43 forming the flow channel member 40 is not limited to the bonding with an adhesive and may be bonding by welding or fastening with a screw, a bolt, or the like. Also, the first flow channel member 41, the second flow channel member 42, and the third flow channel member 43 may be bonded by laser welding by, for example, forming the second flow channel member 42 with a light absorbing member and forming the first flow channel member 41 and the third flow channel member 43 with translucent members.

Also, a seal material or the like for helping prevent leak of ink from the flow channels may be provided between the first flow channel member 41 and the second flow channel member 42 and between the second flow channel member 42 and the third flow channel member 43 of the flow channel member 40. The flow channel member 40 may be formed from a resin member, but the material is not limited to a resin material.

The first flow channel member 41, the second flow channel member 42, and the third flow channel member 43 are each formed of a plate-shaped member which is basically rectangular in shape, long in the direction along the X-axis and short in the direction along the Y-axis. The second flow channel member 42 has a projecting portion 44A at its center portion in the +X-direction, the projecting portion 44A protruding in the +Y-direction. The third flow channel member 43 has a projecting portion 44B at its center portion in the +X-direction, the projecting portion 44B protruding in the +Y-direction. The projecting portion 44A is partially or entirely not covered by the first flow channel member 41, so that the surface of the projecting portion 44A on the −Z-direction side is exposed partially or entirely. In the present embodiment, the projecting portion 44A is partially covered by the first flow channel member 41. This exposed projecting portion 44A of the second flow channel member 42 is provided with inlet portions 201 of the supply flow channels 200 and outlet portions 301 of the collection flow channels 300, which will be described in detail later. The projecting portion 44A overlaps with the projecting portion 44B almost completely when seen in the +Z-direction.

This flow channel member 40 is provided with the supply flow channels 200 for supplying ink to the head units 20, the collection flow channels 300 for collecting ink from the head units 20, the inlet portions 201 through which ink is supplied from the outside to the supply flow channels 200, and the outlet portions 301 through which ink is let out to the outside from the collection flow channels 300. Portions of the supply flow channels 200 and the collection flow channels 300 provided along the XY plane defined by the X-axis and the Y-axis are, as shown in FIGS. 17 and 20, provided at the interface where the first flow channel member 41 and the second flow channel member 42 are affixed to each other and at the interface where the second flow channel member 42 and the third flow channel member 43 are affixed to each other, both of the interfaces being parallel to the XY plane. In the present embodiment, the interface where first flow channel member 41 and the second flow channel member 42 are affixed to each other is referred to as a first interface 45, and the interface where the second flow channel member 42 and the third flow channel member 43 are affixed to each other is referred to as a second interface 46.

A plurality of supply flow channels 200 are provided independently to correspond to the respective kinds (e.g., colors) of ink to be let into the head units 20. In the present embodiment, the flow channel member 40 is provided with four supply flow channels 200. It goes without saying that the supply flow channels 200 may supply the same kind (e.g., color) of ink. In the present embodiment, the four supply flow channels 200 are referred to as the first supply flow channel 200A, a second supply flow channel 200B, a third supply flow channel 200C, and a fourth supply flow channel 200D. Hereinbelow, the first supply flow channel 200A, the second supply flow channel 200B, the third supply flow channel 200C, and the fourth supply flow channel 200D may be generically referred to as the supply flow channels 200. The flow channel member 40 is provided with the inlet portions 201 through which ink is let into the supply flow channels 200 from the outside. In the present embodiment, a first inlet portion 201A, a second inlet portion 201B, a third inlet portion 201C, and a fourth inlet portion 201D are provided as the inlet portions 201 through which ink is supplied to the first supply flow channel 200A, the second supply flow channel 200B, the third supply flow channel 200C, and the fourth supply flow channel 200D, respectively. Hereinbelow, the first inlet portion 201A, the second inlet portion 201B, the third inlet portion 201C, and the fourth inlet portion 201D may be generically referred to as the inlet portions 201. Supplying ink through the supply flow channels 200 to the head units 20 and collecting ink from the head units 20 through the collection flow channels 300, i.e., circulation, is performed mainly at the time of initial filling of the recording head 2 or at the time of maintenance such as expelling air bubbles. It goes without saying that the circulation may be performed also at the time of ejecting ink droplets from the recording head 2 during printing.

The first inlet portion 201A is provided inside a first protrusion portion 47A, extending along the Z-axis. The first protrusion portion 47A is provided on the surface of the second flow channel member 42 on the −Z-direction side, protruding in the −Z-direction. In the present embodiment, the first protrusion portion 47A has a cylindrical shape whose outer diameter is substantially the same throughout the Z-axis direction. Note that the first protrusion portion 47A is not limited to being cylindrical and may have a needle shape having a pointy end. The first inlet portion 201A is provided to penetrate through the second flow channel member 42 in the +Z-direction. The first protrusion portion 47A provided with the first inlet portion 201A is provided at the projecting portion 44A. Then, when the inlet tube provided with the inlet channel 13 is coupled to the first protrusion portion 47A, the inlet channel 13 and the first inlet portion 201A are coupled to each other.

The first supply flow channel 200A includes a first coupling portion 202A, a first distribution portion 203A, and first supply portions 204A.

The first coupling portion 202A has its one end coupled to the first inlet portion 201A and is provided at the second interface 46 along the Y-axis. In other words, the first coupling portion 202A extends in the +Y-direction.

The first distribution portion 203A is provided to extend in the +X-direction, which is an example of a "second direction," and distributes ink to the plurality of, five in the present embodiment, first supply portions 204A. The first distribution portion 203A includes two first distribution flow channel portions 205A provided at the second interface 46 and a first communication portion 206A that allows the two first distribution flow channel portions 205A to communicate with each other.

The first distribution flow channel portions 205A are provided at the second interface 46 along the X-axis. In the present embodiment, the two first distribution flow channel portions 205A are provided at the second interface 46 and are provided at respective sides sandwiching, in the direction along the X-axis, a second coupling portion 202B of the second supply flow channel 200B, a third coupling portion 202C of the third supply flow channel 200C, and a fourth coupling portion 202D of the fourth supply flow channel 200D to be described later.

One of the two first distribution flow channel portions 205A that is provided on the +X-direction side is coupled to the +X-direction end portion of the first communication portion 206A and extends from the first communication portion 206A in the +X-direction. The other one of the two first distribution flow channel portions 205A that is provided on the −X-direction side extends from the other end portion of the first coupling portion 202A in the −X-direction.

The first communication portion 206A is provided at the first interface 45 along the X-axis. The +X-direction end portion and the −X-direction end portion of the first communication portion 206A are coupled to the respective two first distribution flow channel portions 205A via two through-holes 207A penetrating through the second flow channel member 42 in the +Z-direction. When the two first distribution flow channel portions 205A provided at the second interface 46 are thus coupled to each other via the first communication portion 206A provided at the first interface 45, interference of the two first distribution flow channel portions 205A with the other flow channels provided at the second interface 46, namely, the second coupling portion 202B of the second supply flow channel 200B, the third coupling portion 202C of the third supply flow channel 200C, and the fourth coupling portion 202D of the fourth supply flow channel 200D, can be reduced.

By this first distribution portion 203A, ink supplied from the first coupling portion 202A is distributed to the +X-direction side and to the −X-direction side along the X-axis.

Although the first distribution portion 203A includes the first distribution flow channel portions 205A and the first communication portion 206A that extend in the +X-direction and the through-holes 207A that extend in the +Z-direction, what is meant by the first distribution portion 203A extending in the +X-direction is that at least flow channels communicating with the first supply portions 204A, i.e., the first distribution flow channel portions 205A, extend in the +X-direction. Also, the first distribution portion 203A extending in the +X-direction includes a mode where, as long as 50% or more of the flow channel length of the first distribution portion 203A extends in the +X-direction, the rest extends in a direction intersecting with the +X-direction.

Of this first supply flow channel 200A, the flow channel portions provided at the second interface 46, i.e., the first coupling portion 202A and the first distribution flow channel portions 205A, are formed by providing grooves in the second flow channel member 42 that have openings on the +Z-direction surface and lidding the openings of the grooves with the third flow channel member 43. It goes without saying that the flow channel portions provided at the second interface 46 may be formed by, for example, providing grooves in the third flow channel member 43 that have openings on the −Z-direction surface and lidding the openings of the grooves with the second flow channel member, or by providing grooves in both of the second flow channel member 42 and the third flow channel member 43 and bringing the openings of the grooves onto each other.

Of the first supply flow channel 200A, the flow channel portions provided at the first interface 45, i.e., the first communication portion 206A, is formed by providing a groove in the first flow channel member 41 that has an opening on the +Z-direction surface and lidding the opening of the groove with the second flow channel member 42. It goes without saying that the flow channel portion provided at the first interface 45 is not limited to this, and may be formed by, for example, providing a groove in the second flow channel member 42 that has an opening on the −Z-direction surface and lidding the opening of the groove with the first flow channel member 41 or by providing grooves in both of the first flow channel member 41 and the second flow channel member 42 and bringing the openings of the grooves onto each other.

In this way, the flow channel portion provided at the first interface 45 of the flow channel member 40 is formed by provision of a groove in the first flow channel member 41, and the flow channel portions provided at the second interface 46 are formed by provision of grooves in the second flow channel member 42. Thus, the thickness of the second flow channel member 42 in the +Z-direction can be reduced without the flow channel portion provided at the first interface 45 interfering with the flow channel portions provided at the second interface 46. In other words, if the flow channels were formed by providing grooves in both surfaces of the second flow channel member 42 with respect to the Z-axis, i.e., the +Z-direction surface and the −Z-direction surface, the second flow channel member 42 would need to be relatively thick in the +Z-direction in order for the grooves in both surfaces not to interfere with each other. In the present embodiment, the thickness of the second flow channel member 42 in the +Z-direction can be relatively reduced because the flow channels are provided at the first interface 45 and the second interface 46 by providing grooves in only one surface of the first flow channel member 41 and only one surface of the second flow channel member 42. This can reduce size increase in the flow channel member 40 in the +Z-direction.

The first supply portions 204A have their one ends coupled to the first distribution portion 203A and extend in the +Z-direction. A plurality of, five in the present embodiment, first supply portions 204A are provided. Specifically, each first supply portion 204A has its one end coupled to one of the first distribution flow channel portions 205A of the first distribution portion 203A and is provided to penetrate through the third flow channel member 43 in the +Z-direction. The other end of the first supply portion 204A is provided to open into a tip end of a corresponding first supply protrusion portion 48A that is provided on the +Z-direction surface of the third flow channel member 43 and protrudes therefrom in the +Z-direction. This other end of the first supply portion 204A is coupled to the head unit 20. In the present embodiment, five first supply portions 204A supply ink to the respective five head units 20. Specifically, the first supply portion 204A is coupled to the filter chamber inflow channel 115A. The plurality of first supply portions 204A are disposed so that their positions with respect to the Y-axis may be the same. In other words, the plurality of first supply portions 204A are disposed at positions overlapping with one another when seen in the +X-direction. When the first supply portions 204A coincide in position with respect to the Y-axis in this way, the filter chamber inflow channels 115A, which are where the first supply portions 204A are coupled to the head units 20, can coincide in position with one another as well, which allows five head units 20 with the same configuration to be used. Using the head units 20 with the same configuration can reduce the number of components and therefore reduce costs and also can simplify the process of assembling the recording head 2.

In this first supply flow channel 200A, ink let in from the first inlet portion 201A is distributed from the first coupling portion 202A to the two first distribution flow channel portions 205A of the first distribution portion 203A along the X-axis and is then distributed from the first distribution portion 203A into the five first supply portions 204A. Then, the ink is supplied from the five first supply portions 204A to the five head units 20.

The second inlet portion 201B is, like the first inlet portion 201A, provided inside a second protrusion portion 47B, extending in the +Z-direction. The second protrusion portion 47B is provided at the projecting portion 44A, protruding in the −Z-direction.

The second inlet portion 201B is disposed to overlap with the first inlet portion 201A at least partially when seen in the +X-direction. In the present embodiment, the second inlet portion 201B is located farther in the +X-direction than the first inlet portion 201A, and is disposed side by side with the first inlet portion 201A, lining up in the +X-direction.

Like the first supply flow channel 200A, the second supply flow channel 200B includes the second coupling portion 202B, a second distribution portion 203B, and five second supply portions 204B. The second distribution portion 203B has two second distribution flow channel portions 205B, a second communication portion 206B that allows the two second distribution flow channel portions 205B to communicate with each other, and two through-holes 207B. Each second supply portion 204B is provided to open into the +Z-direction end portion of a corresponding second supply protrusion portion 48B. The second supply portions 204B are coupled to the filter chamber inflow channels 115B. Since the second supply flow channel 200B has substantially the same configuration as the first supply flow channel 200A, a further description is omitted to avoid repetition.

The third inlet portion 201C is, like the first inlet portion 201A, provided inside a third protrusion portion 47C, extending in +Z-direction. The third protrusion portion 47C is provided at the projecting portion 44A, protruding in the −Z-direction.

The third inlet portion 201C is disposed to overlap with the first inlet portion 201A at least partially when seen in the +X-direction. In the present embodiment, the third inlet portion 201C is located farther in the +X-direction than the second inlet portion 201B, and is disposed side by side with the second inlet portion 201B, lining up in the +X-direction.

Like the first supply flow channel 200A, the third supply flow channel 200C includes the third coupling portion 202C, a third distribution portion 203C, and five third supply portions 204C. The third distribution portion 203C has two third distribution flow channel portions 205C, a third communication portion 206C that allow the two third distribution flow channel portions 205C to communicate with each other, and two through-holes 207C. Each third supply portions 204C is provided to open into the +Z-direction end portion of a corresponding third supply protrusion portion 48C. The third supply portions 204C are coupled to the filter chamber inflow channels 115C. Since the third supply flow channel 200C has substantially the same configuration as the first supply flow channel 200A, a further description is omitted to avoid repetition.

The fourth inlet portion 201D is, like the first inlet portion 201A, provided inside a fourth protrusion portion 47D, extending in the +Z-direction. The fourth protrusion portion 47D is provided at the projecting portion 44A, protruding in the −Z-direction.

The fourth inlet portion 201D is disposed to overlap with the first inlet portion 201A at least partially when seen in the +X-direction. In the present embodiment, the fourth inlet portion 201D is located farther in the +X-direction than the third inlet portion 201C, and is disposed side by side with the third inlet portion 201C, lining up in the +X-direction.

The fourth supply flow channel 200D includes the fourth coupling portion 202D, a fourth distribution portion 203D, and five fourth supply portions 204D. The fourth distribution portion 203D is formed only of a fourth distribution flow channel portion 205D that is provided at the second interface 46 continuously along the X-axis. Thus, unlike the first supply flow channel 200A, the fourth distribution portion 203D is not provided with portions equivalent to the first communication portion 206A provided at the first interface 45 to couple the separated first distribution flow channel portions 205A to each other and the through-holes 207A. In other words, the fourth distribution flow channel portion 205D of the fourth distribution portion 203D extends from the fourth coupling portion 202D both in the +X-direction and in the −X-direction continuously at the second interface 46. This is because the fourth distribution portion 203D is disposed farther in the −Y-direction than any of the first distribution portion 203A, the second distribution portion 203B, and the third distribution portion 203C, and the fourth distribution portion 203D provided at the second interface 46 does not interfere with any of the first coupling portion 202A, the second coupling portion 202B, and the third coupling portion 202C.

Each fourth supply portions 204D is provided to open into the +Z-direction end portion of a corresponding fourth supply protrusion portion 48D. Hereinafter, the first supply portions 204A, the second supply portions 204B, the third supply portions 204C, and the fourth supply portions 204D are referred to simply as supply portions 204 when no distinction needs to be made. The fourth supply portions 204D are coupled to the filter chamber inflow channel 115D. The supply portions 204 and the filter chamber inflow channels 115 may be coupled to each other directly with an adhesive or the like, or may be coupled via a flexible seal component or tube made of an elastomer or the like. Since the fourth supply flow channel 200D has substantially the same configuration as the first supply flow channel 200A except for the fourth distribution portion 203D, a further description is omitted to avoid repetition.

As described above, the first inlet portion 201A, the second inlet portion 201B, the third inlet portion 201C, and the fourth inlet portion 201D are arranged side by side in this order in the +X-direction. Specifically, the inlet portions 201 are disposed such that the first inlet portion 201A is located farthest in the −X-direction, and the fourth inlet portion 201D is located farthest in the +X-direction. The first inlet portion 201A, the second inlet portion 201B, the third inlet portion 201C, and the fourth inlet portion 201D are disposed to overlap with one another at least partially when seen in the +X-direction. In the present embodiment, the first inlet portion 201A, the second inlet portion 201B, the third inlet portion 201C, and the fourth inlet portion 201D are disposed to line up in the +X-direction at positions overlapping completely when seen in the +X-direction. When the first inlet portion 201A, the second inlet portion 201B, the third inlet portion 201C, and the fourth inlet portion 201D are thus disposed to overlap at least partially when seen in the +X-direction, size increase in the flow channel member 40 in the +Y-direction can be reduced. Also, when the first inlet portion 201A, the second inlet portion 201B, the third inlet portion 201C, and the fourth inlet portion 201D are disposed to line up in the +X-direction at positions overlapping completely when seen in the +X-direction, size increase in the flow channel member 40 in the +Y-direction can be further reduced.

Similarly, the first coupling portion 202A, the second coupling portion 202B, the third coupling portion 202C, and the fourth coupling portion 202D are arranged side by side in this order in the +X-direction. Specifically, the first coupling portion 202A is located farthest in the −X-direction, and the fourth coupling portion 202D is located farthest in the +X-direction.

The first distribution portion 203A, the second distribution portion 203B, the third distribution portion 203C, and the fourth distribution portion 203D are arranged side by side in this order in the −Y-direction. Specifically, the first distribution portion 203A is located farthest in the +Y-direction, and the fourth distribution portion 203D is located farthest in the −Y-direction. Thus, the first coupling portion 202A, the second coupling portion 202B, the third coupling portion 202C, and the fourth coupling portion 202D are provided in different lengths along the Y-axis to agree with the positions of the first distribution portion 203A, the second distribution portion 203B, the third distribution portion 203C, and the fourth distribution portion 203D. Specifically, the first coupling portion 202A is the shortest, the second coupling portion 202B is longer than the first coupling portion 202A, the third coupling portion 202C is longer than the second coupling portion 202B, and the fourth coupling portion 202D is the longest.

The first communication portion 206A, the second communication portion 206B, and the third communication portion 206C are arranged side by side in this order in the −Y-direction. Specifically, the first communication portion 206A is located farthest in the +Y-direction, and the third communication portion 206C is located farthest in the −Y-direction.

The first communication portion 206A is provided at the first interface 45 so as not to interfere with the second coupling portion 202B, the third coupling portion 202C, and the fourth coupling portion 202D that are provided at the second interface 46. In other words, the first communication portion 206A is disposed to overlap with the second coupling portion 202B, the third coupling portion 202C, and the fourth coupling portion 202D when seen in the +Z-direction.

The second communication portion 206B is provided at the first interface 45 so as not to interfere with the third coupling portion 202C and the fourth coupling portion 202D that are provided at the second interface 46. In other words, the second communication portion 206B is disposed to overlap with the third coupling portion 202C and the fourth coupling portion 202D when seen in the +Z-direction.

The third communication portion 206C is provided at the first interface 45 so as not to interfere with the fourth coupling portion 202D provided at the second interface 46. In other words, the third communication portion 206C is disposed to overlap with the fourth coupling portion 202D when seen in the +Z-direction.

The first supply portions 204A, the second supply portions 204B, the third supply portions 204C, and the fourth supply portions 204D are provided to coincide with the flow channels in the head units 20, which are, in the present embodiment, the filter chamber inflow channels 115 in the respective filter units 110. In the present embodiment, the plurality of, i.e., five, first supply portions 204A are disposed so as to be at the same positions with respect to the Y-axis and also at the same positions as the plurality of filter chamber inflow channels 115A with respect to the Y-axis. The same is true of the second supply portions 204B, the third supply portions 204C, and the fourth supply portions 204D.

The first inlet portion 201A is disposed near the center of the flow channel member 40 in the +X-direction. The first inlet portion 201A being disposed near the center of the flow channel member 40 in the +X-direction includes the first inlet portion 201A being located in one of two areas near the center in the +X-direction when the flow channel member 40 is divided into four equal areas in the +X-direction. In other words, as shown in FIG. 21, when the flow channel member 40 is divided into four equal areas in the +X-direction that are denoted as W1, W2, W3, and W4 in this order in the +X-direction, the first inlet portion 201A being disposed near the center of the flow channel member 40 in the +X-direction includes the first inlet portion 201A being located in either W2 or W3. Preferably, the first inlet portion 201A is located in the center area in the +X-direction when the flow channel member 40 is divided into three equal areas in the +X-direction. Specifically, when the flow channel member 40 is divided into three equal areas along the X-axis that are denoted as Wa1, Wa2, and Wa3 in this order in the +X-direction, the first inlet portion 201A is preferably located in Wa2.

Note that the position of the first inlet portion 201A in the +X-direction may also be defined based on the first supply flow channel 200A. Specifically, the first inlet portion 201A being disposed near the center of the flow channel member 40 in the +X-direction includes the first inlet portion 201A being disposed at a position overlapping, when seen in the +Y-direction, with two center areas of the first supply flow channel 200A divided into four equal areas in the +X-direction. Specifically, as shown in FIG. 21, when the first supply flow channel 200A is divided into four equal areas in the +X-direction that are denoted as Wb1, Wb2, Wb3, and Wb4 sequentially in the +X-direction, the first inlet portion 201A being disposed near the center of the flow channel member 40 in the +X-direction includes the first inlet portion 201A being disposed at a position overlapping with either Wb2 or Wb3 when seen in the +Y-direction. Preferably, when the first supply flow channel 200A is divided into three equal areas in the +X-direction, the first inlet portion 201A is disposed at a position overlapping with the center area of the first supply flow channel 200A when seen in the +Y-direction. Specifically, when the first supply flow channel 200A is divided into three equal areas in the +X-direction that are denoted as Wc1, Wc2, and Wc3 sequentially in the +X-direction, the first inlet portion 201A is preferably disposed at a position overlapping with Wc2 when seen in the +Y-direction.

Also, the first inlet portion 201A is disposed inward, in the +X-direction, of the respective outermost head units 20 in the +X-direction, out of the three or more head units 20 arranged side by side in the +X-direction. Specifically, when the five head units 20 arranged side by side in the +X-direction are denoted as a head unit 20A, a head unit 20B, a head unit 20C, a head unit 20D, and a head unit 20E sequentially in the +X-direction as shown in FIG. 21, the first inlet portion 201A is located on the −X-direction side of the endmost head unit 20A in the +X-direction and on the +X-direction side of the endmost head unit 20E in the −X-direction. What is meant by the first inlet portion 201A being disposed inward of the endmost head unit 20A and the endmost head unit 20E in the +X-direction is that the X-axis position of the first inlet portion 201A only needs to be located between the X-axis position of the head unit 20A and the X-axis position of the head unit 20E, and the first inlet portion 201A may be located off of the head units 20B to 20D with respect to the Y-axis. Specifically, the first inlet portion 201A may be disposed at a position not overlapping with the head units 20B to 20D when seen in the +Z-direction. Note that the above description on the first inlet portion 201A also applies to the second inlet portion 201B, the third inlet portion 201C, and the fourth inlet portion 201D.

When the first inlet portion 201A is thus disposed near the center of the flow channel member 40 in the +X-direction, variations in the length among the flow channels from the first inlet portion 201A to the first supply portions 204A can be relatively reduced. Specifically, if, for example, the first inlet portion 201A were disposed at an end portion on the +X-direction side, the length of a flow channel from the first inlet portion 201A to the first supply portion 204A close to the end portion on the +X-direction side would be short, and the length of a flow channel from the first inlet portion 201A to the first supply portion 204A close to an end portion on the −X-direction side would be long. As a result, there would be a large difference between their flow channel lengths. Thus, disposing the first inlet portion 201A close to the center of the flow channel member 40 in the +X-direction can reduce the differences in the flow channel lengths from the first inlet portion 201A to the first supply portions, which in turn reduces variations in pressure loss caused by the differences in the flow channel lengths, allowing reduction in the time required for maintenance such as expelling air bubbles and ink filling and reduction in variations in the ejection performance among the head units 20.

As with the first inlet portion 201A, the second inlet portion 201B, the third inlet portion 201C, and the fourth inlet portion 201D are also disposed near the center of the flow channel member 40 in the +X-direction. Thus, the reduction in variations in the flow channel lengths, the reduction in pressure loss, the reduction in the time required for maintenance, and the reduction in variations in the ejection performance are also achieved for the inks let in from the second inlet portion 201B, the third inlet portion 201C, and the fourth inlet portion 201D and supplied to the head units 20. Also, the performance of the second supply flow channel 200B, the third supply flow channel 200C, and the fourth supply flow channel 200D for expelling air bubbles can be improved to reduce the time it takes for maintenance involving air bubble expelling, which allows reduction in wasteful consumption of ink. Also, when the first inlet portion 201A, the second inlet portion 201B, the third inlet portion 201C, and the fourth inlet portion 201D are disposed close to the center of the flow channel member 40 in the +X-direction, variations in the flow channel length among the first supply flow channel 200A, the second supply flow channel 200B, the third supply flow channel 200C, and the fourth supply flow channel 200D can be reduced.

Like the supply flow channels 200, there are as many independent collection flow channels 300 as the kinds (e.g., colors) of ink to be let out from the filter chamber discharge channels 116 of the head units 20. In the present embodiment, the flow channel member 40 is provided with four collection flow channels 300. It goes without saying that the collection flow channels 300 may collect the same kind (e.g., color) of ink. In the present embodiment, the four collection flow channels 300 are referred to as the first collection flow channel 300A, a second collection flow channel 300B, a third collection flow channel 300C, and a fourth collection flow channel 300D. Hereinbelow, the first collection flow channel 300A, the second collection flow channel 300B, the third collection flow channel 300C, and the fourth collection flow channel 300D may be generically referred to as the collection flow channels 300. Each collection flow channel 300 is provided with an outlet portion 301 through which ink is let out to the outside of the flow channel member 40 from the collection flow channel 300. Specifically, the first collection flow channel 300A, the second collection flow channel 300B, the third collection flow channel 300C, and the fourth collection flow channel 300D are provided with a first outlet portion 301A, a second outlet portion 301B, a third outlet portion 301C, and a fourth outlet portion 301D, respectively. Hereinbelow, the first outlet portion 301A, the second outlet portion 301B, the third outlet portion 301C, and the fourth outlet portion 301D may be generically referred to as the outlet portions 301.

The first outlet portion 301A is provided inside a first outlet protrusion portion 49A, extending along the Z-axis. The first outlet protrusion portion 49A is provided on the −Z-direction surface of the second flow channel member 42, protruding in the −Z-direction. The first outlet protrusion portion 49A has a cylindrical shape whose outer diameter is substantially the same in its axial direction. Note that the first outlet protrusion portion 49A is not limited to being cylindrical, and may have a needle shape having a pointy end. The first outlet portion 301A is provided to penetrate through the second flow channel member 42 along the Z-axis. The first outlet protrusion portion 49A provided with the first outlet portion 301A is provided at the projecting portion 44A. Then, when the inlet tube provided with the discharge channel 14 is coupled to the first outlet protrusion portion 49A, the discharge channel 14 and the first outlet portion 301A are coupled to each other.

The first collection flow channel 300A collects ink supplied from the first supply flow channel 200A to the head units 20. In the present embodiment, the first collection flow channel 300A includes a first outlet coupling portion 302A, a first merge portion 303A, and first collection portions 304A.

The first outlet coupling portion 302A has its one end coupled to the first outlet portion 301A and is provided at the second interface 46 along the Y-axis. In other words, the first outlet coupling portion 302A extends in the +Y-direction.

The first merge portion 303A extends in the +X-direction, and inks from the plurality of, five in the present embodiment, first collection portions 304A merge together in the first merge portion 303A. The first merge portion 303A includes two first merge flow channel portions 305A provided at the second interface 46, a first merge communication portion 306A that couples the first outlet coupling portion 302A to one of the first merge flow channel portions 305A, and a first merge communication coupling portion 307A coupling the first outlet coupling portion 302A to the other one of the first merge flow channel portions 305A.

The first merge flow channel portions 305A are provided at the first interface 45 along the X-axis. Specifically, the present embodiment is provided with two first merge flow channel portions 305A at the first interface 45, and the two first merge flow channel portions 305A are disposed at respective sides sandwiching a second outlet coupling portion 302B, a third outlet coupling portion 302C, and a fourth outlet coupling portion 302D in a direction along the X-axis. In other words, the two first merge flow channel portions 305A provided at the first interface 45 are disposed at the respective ends to sandwich a second merge communication coupling portion 307B, a third merge communication coupling portion 307C, and a fourth merge communication coupling portion 307D that are also provided at the first interface 45.

The first merge communication portion 306A is coupled to the other end of the first outlet coupling portion 302A and extends from the first outlet coupling portion 302A in the +X-direction. The first merge communication portion 306A is provided at the second interface 46 as the first outlet coupling portion 302A is. The first merge communication portion 306A is coupled to the +X-direction one of the two first merge flow channel portions 305A provided at the first interface 45, via a through-hole 308A that penetrates through the second flow channel member 42 in a direction along the Z-axis.

The first merge communication coupling portion 307A is provided at the second interface 46 along the Y-axis. Via another through-hole 308A penetrating through the second flow channel member 42 in a direction along the Z-axis, the first merge communication coupling portion 307A is coupled to the first outlet coupling portion 302A at a position away in the +Y-direction from the other end of the first outlet coupling portion 302A where the first merge communication portion 306A is coupled. The first merge communication coupling portion 307A is coupled to the other one of the two first merge flow channel portions 305A provided at the first interface 45, the other one being provided on the −X-direction side.

Although the first merge portion 303A includes the first merge flow channel portions 305A and the first merge communication portion 306A that extend in +X-direction, the first merge communication coupling portion 307A that extends in the +Y-direction, and the through-holes 308A that extend in the +Z-direction, what is meant by the first merge portion 303A extending in the +X-direction is that at least the first merge flow channel portions 305A communicating with the first collection portions 304A extend in the +X-direction. Also, the first merge portion 303A extending in the +X-direction may include a mode where as long as 50% or more of the flow channel length of the first merge portion 303A extends in the +X-direction, the rest extends in a direction intersecting with the +X-direction.

The first collection portions 304A extend in the +Z-direction. A plurality of, five in the present embodiment, first collection portions 304A are provided. Specifically, each first collection portion 304A has its end coupled to the first merge portion 303A and penetrates through the second flow channel member 42 and the third flow channel member 43 in the +Z-direction. Also, the other end of each first collection portion 304A is provided to open into the tip end of a corresponding first collection protrusion portion 50A that is provided on the +Z-direction-side surface of the third flow channel member 43 and that protrudes in the +Z-direction. This other end of the first collection portion 304A is coupled to the head unit 20. In the present embodiment, the five first collection portions 304A collect inks from the respective five head units 20. Specifically, the first collection portions 304A are coupled to the filter chamber discharge channels 116A of the respective head units 20.

Note that two of the five first collection portions 304A that are provided respectively at an +X-direction end portion of one of the first merge flow channel portions 305A and at an −X-direction end portion of the other one of the first merge flow channel portions 305A are coupled directly to the first merge flow channel portions 305A.

The remaining three of the five first collection portions 304A are coupled to the first merge flow channel portions 305A via first armlet portions 309A that are provided at the first interface 45 and coupled to the first merge flow channel portions 305A. The end portions of the respective first merge flow channel portions 305A are bent slightly in the −Y-direction so that the three first collection portions 304A coupled to the first merge flow channel portions 305A via the three first armlet portions 309A and the two first collection portions 304A coupled to the first merge flow channel portions 305A directly may be located at the same positions with respect to the Y-axis.

With this first collection flow channel 300A, inks collected from the plurality of head units 20 through the first collection portions 304A merge together in the first merge portion 303A, and the merged ink is discharged to the outside from the first outlet portion 301A via the first outlet coupling portion 302A.

Note that flow channel portions of the first collection flow channel 300A that are provided at the first interface 45, namely, the first merge flow channel portions 305A, the first merge communication coupling portion 307A, and the first armlet portions 309A, are formed by providing grooves in the first flow channel member 41 that have openings on the +Z-direction surface and lidding the openings of the grooves with the second flow channel member 42. It goes without saying that the flow channel portions provided at the first interface 45 are not limited to the above and may be formed by, for example, providing grooves in the second flow channel member 42 that have openings on the −Z-direction surface and lidding the openings of the grooves with the first flow channel member 41, or by providing grooves in both of the first flow channel member 41 and the second flow channel member 42 and bringing the openings of the grooves onto each other.

The flow channel portions of the first collection flow channel 300A that are provided at the second interface 46, namely, the first outlet coupling portion 302A and the first merge communication portion 306A are formed by providing grooves in the second flow channel member 42 that have openings on the +Z-direction surface and lidding the openings of the grooves with the third flow channel member 43. It goes without saying that the flow channel portions provided at the second interface 46 may be formed by, for example, providing grooves in the third flow channel member 43 that have openings on the −Z-direction surface and lidding the openings of the grooves with the second flow channel member or by providing grooves in both of the second flow channel member 42 and the third flow channel member 43 and bringing the openings of the grooves onto each other.

As described, the flow channel portions provided at the first interface 45 of the flow channel member 40 are formed by provision of grooves in the first flow channel member 41, and the flow channel portions provided at the second interface 46 are formed by provision of grooves in the second flow channel member 42. Thus, the flow channel portions provided at the first interface 45 and the flow channel portions provided at the second interface 46 do not interfere with each other, which allows reduction in the thickness of the second flow channel member 42 in the +Z-direction. To be more specific, if flow channels were formed by provision of grooves in both of the surfaces of the second flow channel member 42 in terms of the Z-axis, i.e., the +Z-direction surface and the −Z-direction surface, the second flow channel member 42 would need a relatively large thickness in the +Z-direction in order for the grooves provided in both of the surfaces not to interfere with each other. In the present embodiment, the flow channel portions are provided at the first interface 45 and the second interface 46 by provision of grooves only in one of the surfaces of the first flow channel member 41 and only in one of the surfaces of the second flow channel member 42. This allows the thickness of the second flow channel member 42 in the +Z-direction to be relatively reduced, which in turn can reduce size increase in the flow channel member 40 in the +Z-direction.

The second outlet portion 301B is, like the first outlet portion 301A, provided inside a second outlet protrusion portion 49B, extending in the +Z-direction. The second outlet protrusion portion 49B is provided at the projecting portion 44A, protruding in the −Z-direction.

The second outlet portion 301B is disposed to overlap with the first outlet portion 301A at least partially when seen in the +X-direction. In the present embodiment, the second outlet portion 301B is located farther in the +X-direction than the first outlet portion 301A and is arranged side by side with the first outlet portion 301A, lining up in the +X-direction.

The second collection flow channel 300B collects ink supplied from the second supply flow channel 200B to the head units 20. In the present embodiment, the second collection flow channel 300B includes the second outlet coupling portion 302B, a second merge portion 303B, and five second collection portions 304B. The second merge portion 303B includes two second merge flow channel portions 305B, a second merge communication portion 306B, and the second merge communication coupling portion 307B.

Two second merge flow channel portions 305B are provided at the first interface 45, extending mainly along the X-axis.

The second merge communication portion 306B is provided at the second interface 46 along the X-axis. The second merge communication portion 306B communicates with the two second merge flow channel portions 305B through two through-holes 308B penetrating through the second flow channel member 42 in the +Z-direction. In other words, the two second merge flow channel portions 305B communicate with each other via the second merge communication portion 306B.

The second merge communication coupling portion 307B is provided at the first interface 45 along the Y-axis. The second merge communication coupling portion 307B is coupled to the second outlet coupling portion 302B via a through-hole 308B penetrating through the second flow channel member 42 in the +Z-direction.

Each second collection portion 304B is provided to open into the +Z-direction end portion of a corresponding second collection protrusion portion 50B. Some of the second collection portions 304B are provided to communicate with second armlet portions 309B branching off from the second merge flow channel portions 305B. The second collection portions 304B are coupled to the filter chamber discharge channels 116B. Since the configuration of the second collection flow channel 300B is substantially the same as the first collection flow channel 300A except for the second merge portion 303B, a further description is omitted to avoid repetition.

The third outlet portion 301C is, like the first outlet portion 301A, provided inside a third outlet protrusion portion 49C, extending in the +Z-direction. The third outlet protrusion portion 49C is provided at the projecting portion 44A, protruding in the −Z-direction.

The third outlet portion 301C is disposed to overlap with the first outlet portion 301A at least partially when seen in the +X-direction. In the present embodiment, the third outlet portion 301C is located farther in the +X-direction than the second outlet portion 301B and is arranged side by side with the second outlet portion 301B, lining up in the +X-direction.

The third collection flow channel 300C collects ink supplied from the third supply flow channel 200C to the head units 20. In the present embodiment, the third collection flow channel 300C includes the third outlet coupling portion 302C, a third merge portion 303C, and third collection portions 304C. The third merge portion 303C includes two third merge flow channel portions 305C, a third merge communication portion 306C, and the third merge communication coupling portion 307C.

Two third merge flow channel portions 305C are provided at the first interface 45, extending mainly along the X-axis.

The third merge communication portion 306C is provided at the second interface 46, extending along the X-axis. The third merge communication portion 306C communicates with one of the third merge flow channel portions 305C, i.e., the third merge flow channel portion 305C on the +X-direction side, via a through-hole 308C penetrating through the second flow channel member 42 in the +Z-direction.

The third merge communication coupling portion 307C is provided at the first interface 45 along the Y-axis. The third merge communication coupling portion 307C has its +Y-direction end portion coupled to the third outlet coupling portion 302C and its −Y-direction end portion coupled to the third merge communication portion 306C, via two through-holes 308C penetrating through the second flow channel member 42 in the +Z-direction.

Of the two third merge flow channel portions 305C, the other third merge flow channel portion 305C disposed on the −X-direction side is coupled directly to the third merge communication coupling portion 307C at a midway point on the third merge communication coupling portion 307C.

Each third collection portion 304C is provided to open into the +Z-direction end portion of a corresponding third collection protrusion portion 50C. Some of the third collection portions 304C are provided to communicate with third armlet portions 309C branching off from the third merge flow channel portions 305C. The third collection portions 304C are coupled to the filter chamber discharge channels 116C. Since the third collection flow channel 300C has substantially the same configuration as the first collection flow channel 300A except for the third merge portion 303C, a further description is omitted to avoid repetition.

The fourth outlet portion 301D is, like the first outlet portion 301A, provided inside a fourth outlet protrusion portion 49D, extending in the +Z-direction. The fourth outlet protrusion portion 49D is provided at the projecting portion 44A, protruding in the −Z-direction.

The fourth outlet portion 301D is disposed to overlap with the first outlet portion 301A at least partially when seen in the +X-direction. In the present embodiment, the fourth outlet portion 301D is located farther in the +X-direction than the third outlet portion 301C and is arranged side by side with the third outlet portion 301C, lining up in the +X-direction.

The fourth collection flow channel 300D collects ink supplied from the fourth supply flow channel 200D to the head units 20. In the present embodiment, the fourth collection flow channel 300D includes the fourth outlet coupling portion 302D, a fourth merge portion 303D, and fourth collection portions 304D.

The fourth merge portion 303D includes a fourth merge flow channel portion 305D provided at the first interface 45 continuously along the X-axis and the fourth merge communication coupling portion 307D provided at the first interface 45 along the Y-axis. In other words, unlike the first collection flow channel 300A, the fourth merge portion 303D is not provided with portions equivalent to, e.g., the first merge communication portion 306A provided at the second interface 46 to couple the separated first merge flow channel portions 305A to each other. Thus, the fourth merge flow channel portion 305D of the fourth merge portion 303D extends at the first interface 45 from the −Y-direction end portion of the fourth merge communication coupling portion 307D both in the +X-direction and the −X direction continuously. This is because the fourth merge portion 303D is disposed farther in the −Y-direction than the first merge portion 303A, the second merge portion 303B, and the third merge portion 303C, and the fourth merge portion 303D provided at the first interface 45 therefore does not interfere with any of the first merge communication coupling portion 307A, the second merge communication coupling portion 307B, and the third merge communication coupling portion 307C that are also provided at the first interface 45. Note that the fourth outlet coupling portion 302D and the fourth merge communication coupling portion 307D communicate with each other via a through-hole 308D penetrating through the second flow channel member 42 in the +Z-direction.

Each fourth collection portion 304D is provided to open into the +Z-direction end portion of a corresponding fourth collection protrusion portion 50D. Hereinbelow, the first collection portions 304A, the second collection portions 304B, the third collection portions 304C, and the fourth collection portions 304D are referred to simply as collection portions 304 when no distinction needs to be made. Some of the fourth collection portions 304D are provided to communicate with fourth armlet portions 309D branching off from the fourth merge flow channel portion 305D. The fourth collection portions 304D are coupled to the filter chamber discharge channels 116D. The collection portions 304 and the filter chamber discharge channels 116 may be coupled to each other directly with an adhesive or the like, or may be coupled via a flexible seal component or tube made of an elastomer or the like. Since the fourth collection flow channel 300D has substantially the same configuration as the first collection flow channel 300A except for the fourth merge portion 303D, a further description is omitted to avoid repetition.

As described above, the first outlet portion 301A, the second outlet portion 301B, the third outlet portion 301C, and the fourth outlet portion 301D are arranged side by side in this order in the +X-direction. Specifically, they are disposed such that the first outlet portion 301A is located farthest in the −X-direction and the fourth outlet portion 301D is located farthest in the +X-direction. Also, the first outlet portion 301A, the second outlet portion 301B, the third outlet portion 301C, and the fourth outlet portion 301D are disposed to overlap with one another at least partially when seen in the +X-direction. In the present embodiment, the first outlet portion 301A, the second outlet portion 301B, the third outlet portion 301C, and the fourth outlet portion 301D are disposed at positions overlapping with one another completely when seen in the +X-direction, lining up in the +X-direction. When the first outlet portion 301A, the second outlet portion 301B, the third outlet portion 301C, and the fourth outlet portion 301D are thus disposed to overlap with one another at least partially when seen in the +X-direction, size increase in the flow channel member 40 in the +Y-direction can be reduced.

Also, the first outlet portion 301A, the second outlet portion 301B, the third outlet portion 301C, and the fourth outlet portion 301D are located farther in the +X-direction than the fourth inlet portion 201D. In other words, the first inlet portion 201A, the second inlet portion 201B, the third inlet portion 201C, the fourth inlet portion 201D, the first outlet portion 301A, the second outlet portion 301B, the third outlet portion 301C, and the fourth outlet portion 301D are disposed in this order in the +X-direction. In the present embodiment, the first inlet portion 201A and the first outlet portion 301A are disposed to overlap with each other at least partially when seen in the +X-direction. Thus, in the present embodiment, the first inlet portion 201A, the second inlet portion 201B, the third inlet portion 201C, and the fourth inlet portion 201D and the first outlet portion 301A, the second outlet portion 301B, the third outlet portion 301C, and the fourth outlet portion 301D are disposed to overlap with each other at least partially when seen in the +X-direction. Also, in the present embodiment, the first inlet portion 201A, the second inlet portion 201B, the third inlet portion 201C, and the fourth inlet portion 201D and the first outlet portion 301A, the second outlet portion 301B, the third outlet portion 301C, and the fourth outlet portion 301D are disposed at positions overlapping each other completely when seen in the +X-direction, lining up in the +X-direction. When the first inlet portion 201A and the first outlet portion 301A are thus disposed to overlap with each other at least partially when seen in the +X-direction, size increase in the flow channel member 40 in the +Y-direction can be reduced.

The first outlet coupling portion 302A, the second outlet coupling portion 302B, the third outlet coupling portion 302C, and the fourth outlet coupling portion 302D are arranged side by side in this order in the +X-direction. Specifically, the first outlet coupling portion 302A is located farthest in the −X-direction, and the fourth outlet coupling portion 302D is located farthest in the +X-direction.

The first merge flow channel portions 305A of the first merge portion 303A, the second merge flow channel portions 305B of the second merge portion 303B, the third merge flow channel portions 305C of the third merge portion 303C, and the fourth merge flow channel portion 305D of the fourth merge portion 303D are arranged side by side in this order in the −Y-direction. Specifically, the first merge flow channel portions 305A are located farthest in the +Y-direction, and the fourth merge flow channel portion 305D is located farthest in the −Y-direction. Thus, the first merge communication coupling portion 307A, the second merge communication coupling portion 307B, the third merge communication coupling portion 307C, and the fourth merge communication coupling portion 307D are provided in different lengths in the +Y-direction to agree with the positions of the first merge flow channel portions 305A, the second merge flow channel portions 305B, the third merge flow channel portions 305C, and the fourth merge flow channel portion 305D. Specifically, the first merge communication coupling portion 307A is the shortest, the second merge communication coupling portion 307B is longer than the first merge communication coupling portion 307A, the third merge communication coupling portion 307C is longer than the second merge communication coupling portion 307B, and the fourth merge communication coupling portion 307D is the longest.

The first merge flow channel portions 305A and the second merge flow channel portions 305B are located farther in the −Y-direction than the first distribution flow channel portions 205A. Also, the third merge flow channel portions 305C and the fourth merge flow channel portion 305D are provided between the second distribution flow channel portions 205B and the third distribution flow channel portions 205C in the +Y-direction.

In other words, the first merge flow channel portions 305A, the second merge flow channel portions 305B, the first distribution flow channel portions 205A, the second distribution flow channel portions 205B, the third merge flow channel portions 305C, the fourth merge flow channel portion 305D, the third distribution flow channel portions 205C, and the fourth distribution flow channel portion 205D are arranged side by side in this order in the −Y-direction. When the first merge flow channel portions 305A is thus disposed farther in the +Y-direction than the first distribution flow channel portions 205A, the first merge flow channel portions 305A can be disposed on the −G-direction side, i.e., vertically upward, relative to the first distribution flow channel portions 205A when the direction in which the head units 20 eject ink droplets, which is the +Z-direction, is slanted relative to the +G-direction, which is the direction of gravitational force, as described above. When the first merge flow channel portions 305A is thus disposed on the −G-direction side, i.e., vertically upward, of the first distribution flow channel portions 205A, the filter chamber discharge channels 116A of the head units 20 can be disposed on the −G-direction side, i.e., vertically upward, of the filter chamber inflow channels 115A, which improves the performance for expelling air bubbles in the filter chambers 111 through the filter chamber discharge channels 116A. The same is true of the other supply flow channels 200 and collection flow channels 300.

Also, the first merge communication portion 306A, the second merge communication portion 306B, and the third merge communication portion 306C are arranged side by side in this order in the −Y-direction. Specifically, the first merge communication portion 306A is located farthest in the +Y-direction, and the third merge communication portion 306C is located farthest in the −Y-direction.

The first merge communication portion 306A is provided at the second interface 46 so as not to interfere with the second merge communication coupling portion 307B, the third merge communication coupling portion 307C, and the fourth merge communication coupling portion 307D that are provided at the first interface 45. In other words, the first merge communication portion 306A is disposed to overlap with the second merge communication coupling portion 307B, the third merge communication coupling portion 307C, and the fourth merge communication coupling portion 307D when seen in the +Z-direction.

The second merge communication portion 306B is provided at the second interface 46 so as not to interfere with the third merge communication coupling portion 307C and the fourth merge communication coupling portion 307D that are provided at the first interface 45. In other words, the second merge communication portion 306B is disposed to overlap with the third merge communication coupling portion 307C and the fourth merge communication coupling portion 307D when seen in the +Z-direction.

The third merge communication portion 306C is provided at the second interface 46 so as not to interfere with the fourth merge communication coupling portion 307D provided at the first interface 45. In other words, the second merge communication portion 306B is disposed to overlap with the fourth merge communication coupling portion 307D when seen in the +Z-direction.

The first collection portions 304A, the second collection portions 304B, the third collection portions 304C, and the fourth collection portions 304D are provided to coincide with the positions of the flow channels in the head units 20, specifically, the filter chamber discharge channels 116. The plurality of, five in the present embodiment, first collection portions 304A are disposed at the same positions with respect to the Y-axis. In other words, the five first collection portions 304A are disposed to overlap with one another when seen in the +X-direction. The same is true of the second collection portions 304B, the third collection portions 304C, and the fourth collection portions 304D.

The first outlet portion 301A is disposed near the center of the flow channel member 40 in the +X-direction. Here, the first outlet portion 301A being disposed near the center of the flow channel member 40 in the +X-direction includes the first outlet portion 301A being located in one of two areas near the center in the +X-direction when the flow channel member 40 is divided into four equal areas in the +X-direction. Specifically, as shown in FIG. 22, when the flow channel member 40 is divided into four equal areas W1, W2, W3, and W4 in the +X-direction, the first outlet portion 301A being disposed near the center of the flow channel member 40 in the +X-direction includes the first outlet portion 301A being located in either W2 or W3. Preferably, the first outlet portion 301A is located in the center area in the +X-direction when the flow channel member 40 is divided into three equal areas in the +X-direction. Specifically, when the flow channel member 40 is divided into three equal areas Wa1, Wa2, and Wa3 in the +X-direction, the first outlet portion 301A is preferably located in Wa2.

Note that the position of the first outlet portion 301A with respect to the X-axis may also be defined based on the first collection flow channel 300A. Specifically, the first outlet portion 301A being disposed near the center of the flow channel member 40 in the +X-direction includes the first outlet portion 301A being disposed at a position overlapping, when seen in the +Y-direction, with two center areas of the first collection flow channel 300A divided into four equal areas in the +X-direction. Specifically, as shown in FIG. 22, when the first collection flow channel 300A is divided into four equal areas in the +X-direction that are denoted as Wd1, Wd2, Wd3, and Wd4 sequentially in the +X-direction, the first outlet portion 301A being disposed near the center of the flow channel member 40 in the +X-direction includes the first outlet portion 301A being disposed at a position overlapping with either Wd2 or Wd3 when seen in the +Y-direction. Preferably, the first outlet portion 301A is disposed at a position overlapping with the center area of the first collection flow channel 300A when seen in the +Y-direction when the first collection flow channel 300A is divided into three equal areas in the +X-direction. Specifically, when the first collection flow channel 300A is divided into three equal areas in the +X-direction that are denoted as We1, We2, and We3 sequentially in the +X-direction, the first outlet portion 301A is preferably disposed at a position overlapping with We2 when seen in the +Y-direction.

Also, the first outlet portion 301A is disposed inward, in the +X-direction, of the endmost head units 20 in the +X-direction out of the three or more head units 20 arranged side by side in the +X-direction. Specifically, when the five head units 20 arranged side by side in the +X-direction are denoted as the head unit 20A, the head unit 20B, the head unit 20C, the head unit 20D, and the head unit 20E sequentially in the +X-direction as shown in FIG. 22, the first outlet portion 301A is located on the +X-direction side of the endmost head unit 20A in the −X-direction and on the −X-direction side of the endmost head unit 20E in the +X-direction. What is meant by the first outlet portion 301A being disposed inward of the endmost head unit 20A and the endmost head unit 20E in the +X-direction is that the X-axis position of the first outlet portion 301A only needs to be located between the X-axis position of the head unit 20A and the X-axis position of the head unit 20E, and the first outlet portion 301A may be located off of the head units 20B to 20D with respect to the Y-axis. Specifically, the first outlet portion 301A may be disposed at a position not overlapping with the head units 20B to 20D when seen in the +Z-direction. Note that the above description on the first outlet portion 301A applies also to the second outlet portion 301B, the third outlet portion 301C, and the fourth outlet portion 301D.

When the first outlet portion 301A is thus disposed near the center of the flow channel member 40 in the +X-direction, variations in the length among the flow channels from the first outlet portion 301A to the first collection portions 304A can be reduced in comparison with a case where the first outlet portion 301A is disposed at an end portion in the +X-direction or an end portion in the −X-direction. This can improve the performance for expelling air bubbles contained in ink in the first collection flow channel 300A through the first outlet portion 301A and also can reduce variations in the air bubble expelling performance. That is, when the flow channel from the first outlet portion 301A to each of the first collection portions 304A is long, it takes a longer time to expel air bubbles and also requires higher pressure for cleaning. Shortening the flow channel from the first outlet portion 301A to each of the first collection portions 304A allows reduction in the time required for expelling air bubbles and cleaning with relatively low pressure suction.

Like the first outlet portion 301A, the second outlet portion 301B, the third outlet portion 301C, and the fourth outlet portion 301D are also disposed near the center of the flow channel member 40 in the +X-direction. Thus, the second collection flow channel 300B, the third collection flow channel 300C, and the fourth collection flow channel 300D can also achieve the reduction in the flow channels from each of the outlet portions 301 to the collection portions 304A to 304D, the reduction in variations in the flow channel length, the improvement in the air bubble expelling performance, and the reduction in variations in the air bubble expelling performance.

The first outlet portion 301A, the second outlet portion 301B, the third outlet portion 301C, and the fourth outlet portion 301D are, as described earlier, provided at the projecting portion 44A of the flow channel member 40 projecting in the +Y-direction. Thus, the first outlet portion 301A is disposed on the +Y-direction side relative to the first merge portion 303A and the first distribution portion 203A. The recording head 2 is, as described earlier, disposed such that the +Y-direction end portion of the ejection face 100*a* is located upward in the direction of gravitational force, i.e., the −G-direction side, of the opposite −Y-direction end portion of the ejection face 100*a*. This allows air bubbles in the recording head 2 to move toward the first outlet portion 301A buoyantly, facilitating the air bubble expelling from the first outlet portion 301A, which means improved air bubble expelling performance.

Also, in the present embodiment, the second outlet portion 301B is disposed on the +Y-direction side relative to the second merge portion 303B and the second distribution portion 203B. The third outlet portion 301C is disposed on the +Y-direction side relative to the third merge portion 303C and the third distribution portion 203C. The fourth outlet portion 301D is disposed on the +Y-direction side relative to the fourth merge portion 303D and the fourth distribution portion 203D. Thus, like the first outlet portion 301A, the second outlet portion 301B, the third outlet portion 301C, and the fourth outlet portion 301D also improve the air bubble expelling performance.

Also, as described earlier, the first merge flow channel portions 305A is located farther in the +Y-direction than the first distribution flow channel portions 205A. Thus, as shown in FIGS. 12 and 13, a first distance L1 in the +Y-direction from the first outlet portion 301A to the first merge portion 303A of the first collection flow channel 300A is shorter than a second distance L2 in the +Y-direction from the first inlet portion 201A to the first distribution portion 203A of the first supply flow channel 200A (L1<L2).

The first distance L1 in the +Y-direction from the first outlet portion 301A to the first merge portion 303A of the first collection flow channel 300A is the flow channel length of a portion of the first collection flow channel 300A extending in +Y-direction, the portion being from a point coupled to the first outlet portion 301A to the last merge point of the first merge portion 303A. In other words, the first distance L1 is the flow channel length from a point where the first outlet coupling portion 302A is coupled to the first outlet portion 301A to a point where the first outlet coupling portion 302A is coupled to the through-hole 308A communicating with the first merge communication coupling portion 307A.

The second distance L2 in the +Y-direction from the first inlet portion 201A to the first distribution portion 203A of the first supply flow channel 200A is the flow channel length of a portion of the first supply flow channel 200A extending in +Y-direction, the portion being from a point coupled to the first inlet portion 201A to the first distribution point of the first distribution portion 203A. In other words, the second distance L2 is the flow channel length of the first coupling portion 202A.

When the first distance L1 of the portion of the first collection flow channel 300A extending in the +Y-direction is thus shorter than the second distance L2 of the portion of the first supply flow channel 200A extending in the +Y-direction, the flow channel length of the first collection flow channel 300A can be made shorter than the flow channel length of the first supply flow channel 200A, which can improve the air bubble expelling performance of the first collection flow channel 300A. Note that a combination of the second collection flow channel 300B and the second supply flow channel 200B, a combination of the third collection flow channel 300C and the third supply flow channel 200C, and a combination of the fourth collection flow channel 300D and the fourth supply flow channel 200D can also have the same configuration as the first collection flow channel 300A and the first supply flow channel 200A.

Also, as described above, the first inlet portion 201A and the first outlet portion 301A are disposed on the +Y-direction side relative to the second merge portion 303B and the second distribution portion 203B. Also, the second inlet portion 201B and the second outlet portion 301B are disposed on the +Y-direction side relative to the first merge portion 303A and the first distribution portion 203A.

A third distance L3 in the +Y-direction from the second outlet portion 301B to the second merge portion 303B of the second collection flow channel 300B is shorter than a fourth distance L4 in the +Y-direction from the second inlet portion 201B to the second distribution portion 203B of the second supply flow channel 200B (L3<L4). The first distance L1 is shorter than the third distance L3 (L1<L3), and the second distance L2 is shorter than the fourth distance L4 (L2<L4).

The third distance L3 in the +Y-direction from the second outlet portion 301B to the second merge portion 303B of the second collection flow channel 300B is the flow channel length of a portion of the second collection flow channel 300B extending in the +Y-direction, the portion being from a point coupled to the second outlet portion 301B to the last merge point of the second merge portion 303B. In other words, the third distance L3 is the total flow channel length of the second outlet coupling portion 302B and the second merge communication coupling portion 307B.

The fourth distance L4 in the +Y-direction from the second inlet portion 201B to the second distribution portion 203B of the second supply flow channel 200B is the flow channel length of a portion of the second supply flow channel 200B extending in the +Y-direction, the portion being from a point coupled to the second inlet portion 201B to the first distribution point of the second distribution portion 203B. In other words, the fourth distance L4 is the flow channel length of the second coupling portion 202B.

When the first distance L1, the second distance L2, the third distance L3, and the fourth distance L4 satisfy the above relations, variations in the difference in flow channel resistance among the supply flow channels 200 and the collection flow channels 300 of the respective ink systems can be reduced, which reduces variations in the circulation flow rate when inks are circulated from the supply flow channels 200 to the collection flow channels 300. Thus, the ink systems can have balanced air bubble expelling performance, reducing wasteful consumption of ink during maintenance performed to expel air bubbles.

As described above, the ink jet recording head 2 of the present embodiment, which is an example of a liquid ejecting head, ejects ink, which is a liquid, in the +Z-direction, which is a first direction. The recording head 2 includes the plurality of head units 20 arranged side by side in the +X-direction, which is a second direction, orthogonal to the +Z-direction, the first supply flow channel 200A through which ink is supplied to the plurality of head units 20, and the first collection flow channel 300A through which ink is collected from the head units 20. The recording head 2 includes the flow channel member 40 that has the first inlet portion 201A through which a liquid is let into the first supply flow channel 200A from the outside and the first outlet portion 301A through which a liquid is let out to the outside from the first collection flow channel 300A. The first inlet portion 201A and the first outlet portion 301A are disposed near the center of the flow channel member 40 in the +X-direction.

When the first inlet portion 201A and the first outlet portion 301A are thus disposed near the center of the flow channel member 40 in the +X-direction, the flow channel lengths from the first inlet portion 201A to the first supply portions 204A as well as the flow channel lengths from the first outlet portion 301A to the first collection portions 304A can be shortened. Thus, not only can the flow channel lengths from the first inlet portion 201A to the first supply portions 204A of the first supply flow channel 200A be shortened, variations in the flow channel length among the flow channels can be reduced.

Preferably, in the recording head 2 of the present embodiment, three or more head units 20 are arranged side by side in the +X-direction, which is the second direction, and the first inlet portion 201A and the first outlet portion 301A are disposed inward, in the +X-direction, of the endmost head units 20 in the +X-direction out of the three or more head units 20. When the first inlet portion 201A and the first outlet portion 301A are thus disposed inward, in the +X-direction, of the endmost head units 20 in the +X-direction, the flow channel lengths from the first inlet portion 201A to the head units 20 can be shortened relatively, which allows reduction in the variations in the flow channel length.

Further, the recording head 2 of the present embodiment is, during use, slanted such that the ejection face 100*a* that ejects ink, which is a liquid, has its end portion 100*b* in the +Y-direction located upward in the +G-direction, which is the direction of gravitational force, i.e., on the −G-direction side, of the end portion 100*c* of the ejection face 100*a* in the −Y-direction which is the opposite from the +Y-direction, the +Y-direction being a third direction and orthogonal to the +Z-direction, which is the first direction, and the +X-direction, which is the second direction. The first supply flow channel 200A has the first distribution portion 203A extending in the +X-direction, and the first collection flow channel 300A has the first merge portion 303A extending in the +X-direction. Preferably, the first outlet portion 301A is disposed on the +Y-direction side relative to the first merge portion 303A and the first distribution portion 203A. When the first outlet portion 301A is disposed on the +Y-direction side relative to the first merge portion 303A and the first distribution portion 203A, air bubbles in the ink in the first collection flow channel 300A move toward the first outlet portion 301A buoyantly when the recording head 2 is slanted such that the first outlet portion 301A is located vertically upward, i.e., on the −G-direction side. This facilitates expelling of air bubbles in the first collection flow channel 300A from the first outlet portion 301A.

Also, in the recording head 2 of the present embodiment, the flow channel member 40 has the second supply flow channel 200B through which ink, which is a liquid, is supplied to the plurality of head units 20, the second collection flow channel 300B through which ink is collected from the plurality of head units 20, the second inlet portion 201B through which ink is let into the second supply flow channel 200B from the outside, and the second outlet portion 301B through which ink is let out to the outside from the second collection flow channel 300B. The second inlet portion 201B and the second outlet portion 301B are disposed near the center of the flow channel member 40 in the +X-direction, which is the second direction, and the second supply flow channel 200B has the second distribution portion 203B extending in the +X-direction. The second collection flow channel 300B has the second merge portion 303B extending in the +X-direction. The first inlet portion 201A and the first outlet portion 301A are disposed on the +Y-direction side, which is the third direction, relative to the second merge portion 303B and the second distribution portion 203B, and the second inlet portion 201B and the second outlet portion 301B are disposed on the +Y-direction side relative to the first merge portion 303A, the second merge portion 303B, the first distribution portion 203A, and the second distribution portion 203B. Preferably, the third distance L3 in the +Y-direction from the second outlet portion 301B to the second merge portion 303B is shorter than the fourth distance L4 in the +Y-direction from the second inlet portion 201B to the second distribution portion 203B, the first distance L1 is shorter than the third distance L3, and the second distance L2 is shorter than the fourth distance L4.

When the first distance L1, the second distance L2, the third distance L3, and the fourth distance L4 satisfy the above relations, variations in the difference in flow channel resistance between the supply flow channels 200 and the collection flow channels 300 in each ink system can be reduced, which reduces variations in the circulation flow rate when ink is circulated from the supply flow channels 200 to the collection flow channels 300.

Preferably, in the recording head 2 of the present embodiment, the first inlet portion 201A, the second inlet portion 201B, the first outlet portion 301A, and the second outlet portion 301B are disposed in this order, lining up in the +X-direction, which is the second direction. When the first inlet portion 201A, the second inlet portion 201B, the first outlet portion 301A, and the second outlet portion 301B are thus disposed lining up in the +X-direction, variations in the flow channel length among the supply flow channels 200 can be reduced.

Also, the ink jet recording apparatus 1 of the present embodiment, which is a liquid ejecting apparatus, includes the above-described recording head 2, which is a liquid ejecting head, and the retention member 6 that retains the recording head 2.

The retention member 6 retains the recording head 2 such that the recording head 2 is slanted relative to the horizontal plane, so that the end portion 100*b* of the ejection face 100*a*, of the recording head 2, that ejects ink may be upward of the end portion 100*c* of the ejection face 100*a* in the +G-direction, which is the direction of gravitational force, the end portion 100*b* being on the +Y-direction side, which is the third direction, and the end portion 100*c* being opposite from the +Y-direction side.

When the recording head 2 is thus slanted, the first outlet portion 301A, the second outlet portion 301B, and so on can be disposed upward relative to the first collection flow channel 300A, the second collection flow channel 300B, and so on in the +G-direction, which is the direction of gravitational force. Thus, air bubbles in the first collection flow channel 300A and the second collection flow channel 300B can buoyantly move to the first outlet portion 301A and the second outlet portion 301B, allowing improvement in the performance for expelling air bubbles from the first outlet portion 301A and the second outlet portion 301B.

Preferably, in the ink jet recording apparatus 1 of the present embodiment, the recording head 2, which is a liquid ejecting head, is a line head that is long in the +X-direction, which is the second direction. Even if the recording head 2 is a line head that is long in the +X-direction, according to the above configuration, variations among the flow channels such as the first supply flow channel 200A, the second supply flow channel 200B, the first collection flow channel 300A, and the second collection flow channel 300B can be reduced.

Although an embodiment of the present disclosure has been described above, the basic configuration of the present disclosure is not limited to the above.

For example, although the embodiment described above exemplifies a line head configuration in which the recording head 2 is affixed to the casing 7, the present disclosure is not limited to this. For example, the recording head 2 may be what is called a serial head that moves in a direction intersecting with the medium transportation direction.

In the embodiment described above, the recording head 2 is oriented such that the +Z-direction, which is the direction of ink droplet ejection, is slanted relative to the +G-direction, which is downward in the direction of gravitational force. However, the present disclosure is not limited to this. The +Z-direction may be slanted relative to the +G-direction only at the time of printing or maintenance. In other words, the recording head 2 may be in a posture such that the +Z-direction, which is the ink droplet ejecting direction, coincides with the +G-direction at the time of one of printing and maintenance and is slanted relative to the +G-direction at the time of the other one of printing and maintenance.

Although the first outlet portion 301A, the second outlet portion 301B, the third outlet portion 301C, and the fourth outlet portion 301D are disposed lining up in the +X-direction in the above embodiment, the present disclosure is not limited to this. The first outlet portion 301A, the second outlet portion 301B, the third outlet portion 301C, and the fourth outlet portion 301D do not have to be disposed lining up in the +X-direction.

Although the first inlet portion 201A and the first outlet portion 301A in the above embodiment are disposed at positions not overlapping with the first distribution portion 203A and first merge portion 303A, respectively, when seen in the +Z-direction, the present disclosure is not limited to this. One or both of the first inlet portion 201A and the first outlet portion 301A may be disposed at a position overlapping with the first distribution portion 203A or the first merge portion 303A when seen in the +Z-direction. The same is true of the second inlet portion 201B, the second outlet portion 301B, the third inlet portion 201C, the third outlet portion 301C, the fourth inlet portion 201D, and the fourth outlet portion 301D.

Although the collection flow channels 300 are used as flow channels to collect ink from the head units 20 in the above embodiment, they may be used as collection flow channels at the time of maintenance and used as supply flow channels at the time of printing, particularly for printing with a high print coverage, such as solid printing. When the collection flow channels 300 are thus used as supply flow channels, ink can be supplied to the head units 20 through both of the supply flow channels 200 and the collection flow channels 300, enabling stable ink supply. Also, when the first distance L1, the second distance L2, the third distance L3, and the fourth distance L4 satisfy the relations described above, variations in the flow channel resistance between the supply flow channels 200 and the collection flow channels 300 in each system can be reduced, enabling the ink ejection weights to be even.

What is claimed is:

1. A liquid ejecting head configured to eject a liquid in a first direction, comprising:

head units arranged side by side in a second direction orthogonal to the first direction; and a flow channel member having a first supply flow channel through which the liquid is supplied to the head units, a first collection flow channel through which the liquid is collected from the head units, a first inlet portion through which the liquid is let into the first supply flow channel from outside, and a first outlet portion through which the liquid is let out to outside from the first collection flow channel, wherein the first inlet portion and the first outlet portion are disposed near a center of the flow channel member with respect to the second direction.

2. The liquid ejecting head according to claim 1, wherein the head units include three or more head units arranged side by side in the second direction, the three or more head units include a first head unit and a second head unit being disposed at both ends with respect to the second direction among the three or more head units, and the first inlet portion and the first outlet portion are disposed between the first head unit and the second head unit with respect to the second direction.

3. The liquid ejecting head according to claim 1 further comprising an ejection surface, wherein during use, the liquid ejecting head is slanted such that a first end portion of the ejection surface is located upward of a second end portion of the ejection surface in a direction of gravitational force, the first end portion being an end portion in a third direction orthogonal to the first direction and the second direction and the second end portion being an end portion in a direction opposite from the third direction, the first supply flow channel has a first distribution portion extending in the second direction, the first collection flow channel has a first merge portion extending in the second direction, and the first outlet portion is disposed farther in the third direction than the first merge portion and the first distribution portion.

4. The liquid ejecting head according to claim 3, wherein the first inlet portion is disposed farther in the third direction than the first merge portion and the first distribution portion, the first inlet portion and the first outlet portion overlap with each other at least partially when seen in the second direction, and a first distance in the third direction from the first outlet portion to the first merge portion is shorter than a second distance in the third direction from the first inlet portion to the first distribution portion.

5. The liquid ejecting head according to claim 4, wherein the flow channel member has a second supply flow channel through which the liquid is supplied to the head units, a second collection flow channel through which the liquid is collected from the head units, a second inlet portion through which the liquid is let into the second supply flow channel from outside, and a second outlet portion through which the liquid is let out to outside from the second collection flow channel, the second inlet portion and the second outlet portion are disposed near the center of the flow channel member in the second direction, the second supply flow channel has a second distribution portion extending in the second direction, the second collection flow channel has a second merge portion extending in the second direction, the first inlet portion and the first outlet portion are disposed farther in the third direction than the second merge portion and the second distribution portion, the second inlet portion and the second outlet portion are disposed farther in the third direction than the first merge portion, the second merge portion, the first distribution portion, and the second distribution portion, a third distance in the third direction from the second outlet portion to the second merge portion is shorter than a fourth distance in the third direction from the second inlet portion to the second distribution portion, the first distance is shorter than the third distance, and the second distance is shorter than the fourth distance.

6. The liquid ejecting head according to claim 5, wherein the first inlet portion, the second inlet portion, the first outlet portion, and the second outlet portion are disposed in this order, lining up in the second direction.

7. A liquid ejecting apparatus comprising:

the liquid ejecting head according to claim 1 and a retention member that retains the liquid ejecting head.

8. The liquid ejecting apparatus according to claim 7, wherein the liquid ejecting head includes an ejecting surface and, the retention member retains the liquid ejecting head in a manner slanted relative to a horizontal plane such that a first end portion of the ejection surface is upward of a second end portion of the ejection surface, the first end portion being an end portion in a third direction orthogonal to the first direction and the second direction and the second end portion being an end portion in a direction opposite from the third direction.

9. The liquid ejecting apparatus according to claim 8, wherein the liquid ejecting head is a line head elongated in the second direction.

* * * * *